US011581179B2

(12) United States Patent
Silveira et al.

(10) Patent No.: US 11,581,179 B2
(45) **Date of Patent: *Feb. 14, 2023**

(54) ION FUNNELS AND SYSTEMS INCORPORATING ION FUNNELS

(71) Applicants: THERMO FINNIGAN LLC, San Jose, CA (US); Thermo Fisher Scientific (Bremen) GmbH, Bremen (DE)

(72) Inventors: Joshua A. Silveira, San Jose, CA (US); Eloy R. Wouters, San Jose, CA (US); Alexander A. Makarov, Bremen (DE); Mikhail G. Skoblin, Dolgoprudny (RU); Viacheslav I. Kozlovskiy, Chernogolovka (RU); Christopher Mullen, Menlo Park, CA (US); Brian D. Adamson, Menlo Park, CA (US)

(73) Assignees: Thermo Finnigan LLC, San Jose, CA (US); Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/467,033

(22) Filed: Sep. 3, 2021

(65) Prior Publication Data

US 2021/0398791 A1 Dec. 23, 2021

Related U.S. Application Data

(63) Continuation-in-part of application No. 16/868,783, filed on May 7, 2020, now Pat. No. 11,114,290.

(51) Int. Cl.
*H01J 49/06* (2006.01)

(52) U.S. Cl.
CPC ..... *H01J 49/066* (2013.01)

(58) Field of Classification Search
CPC ..... H01H 49/066; H01H 49/24
(Continued)

(56) References Cited

U.S. PATENT DOCUMENTS 6,107,628 A 8/2000 Smith et al.
7,351,964 B2 4/2008 Tolmachev et al.
(Continued)

FOREIGN PATENT DOCUMENTS

EP 1465234 A2 10/2004
EP 1367633 B1 9/2006
(Continued)

OTHER PUBLICATIONS

Covey et al., "Atmospheric Pressure Ion Sources", Mass Spectrometry Reviews, 2009, 28, pp. 870-897.
(Continued)

*Primary Examiner* — Nicole M Ippolito
(74) *Attorney, Agent, or Firm* — Thomas F. Cooney

(57) ABSTRACT

A method of reducing fragmentation of ions generated from a sample during transport of the ions through an ion transport apparatus that comprises an ion funnel portion, comprises: applying a selected DC potential difference between an outlet end of the ion transport apparatus and an exit ion lens that is disposed adjacent to the outlet end, wherein a sign of the selected DC potential difference is chosen so as to accelerate the ions from the outlet end of the ion transport apparatus towards and through the exit ion lens.

22 Claims, 21 Drawing Sheets

(58) Field of Classification Search
USPC ..... 250/281, 282, 283, 289, 290
See application file for complete search history.

(56) References Cited

U.S. PATENT DOCUMENTS

| | | | | |
|---|---|---|---|---|
| 8,907,272 | B1 | 12/2014 | Wouters et al. | |
| 9,761,427 | B2 | 9/2017 | Wouters et al. | |
| 11,114,290 | B1 * | 9/2021 | Silveira | H01J 49/24 |
| 2005/0006579 | A1 | 1/2005 | Franzen | |
| 2015/0276676 | A1 | 10/2015 | Jiang et al. | |
| 2016/0189946 | A1 | 6/2016 | Nishiguchi et al. | |
| 2020/0185209 | A1 | 6/2020 | Cui | |

FOREIGN PATENT DOCUMENTS

| | | | |
|---|---|---|---|
| EP | 1738398 | B1 | 6/2015 |
| EP | 1454337 | B1 | 12/2015 |
| EP | 2858089 | B1 | 10/2017 |

OTHER PUBLICATIONS

Prasad et al., "Advancement of Atmospheric-Vacuum Interfaces for Mass Spectrometers with a Focus on Increasing Gas Throughput forImproving Sensitivity", Anal. Chem. 2015, 87, pp. 8234-8241.
Ridgeway et al., "Trapped ion mobility spectrometry: A short review", International Journal of Mass Spectrometry 425 (2018), pp. 22-35.

* cited by examiner

Mean Abundance Ratio
3mm Funnel RF60% / Standard Funnel RF30%
4.0
3.5
3.0
2.5
2.0
1.5
1.0
0.5
0.0
300
500
700
900
1100
1300
1500
1700
m/z Bins Dynamic Range (log10)
7.0
6.0
5.0
4.0
3.0
2.0
1.0
0.0
300
700
1100
1500
m/z Bins
133
131

ION FUNNELS AND SYSTEMS INCORPORATING ION FUNNELS

CROSS-REFERENCE TO RELATED APPLICATION

This application is a Continuation-in-Part of and claims the benefit of priority to co-assigned U.S. patent application Ser. No. 16/868,783, now U.S. Pat. No. 11/114,290, which was filed on May 7, 2020, the disclosure of which is hereby incorporated by reference in its entirety.

TECHNICAL FIELD

The present disclosure relates to mass spectrometry. More particularly, the present disclosure relates to ion guides comprising a plurality of ring electrodes arranged in a stacked configuration.

BACKGROUND

Over the past two decades, the ion funnel has become an established component of efficient atmospheric pressure ion sources. The ion funnel is comprised of a stack of RF electrodes having apertures that progressively decrease in diameter toward a gas-conductance-limiting aperture. FIG. 1A provides a schematic depiction of such an ion funnel apparatus 1 in both a longitudinal cross-sectional view (left-hand side) and end-on view (right-hand side) as viewed along the longitudinal axis 1. Generally described, the ion funnel device consists of a multitude of closely longitudinally spaced ring electrodes, such as the four illustrated ring electrodes 2*a*-2*d*, that have apertures that decrease in size from the entrance of the device to its exit at exit aperture 5. The electrodes are spaced apart by a constant inter-electrode distance, d, referred to herein as the "pitch" of the funnel. The rate of change of the apertures along the length of the funnel defines a funnel half-half angle, α, as shown. The apertures are defined by the ring inner surfaces 3 and the ion entrance corresponds with the largest aperture (not shown), and the ion exit corresponds with the smallest aperture (i.e., the exit aperture) 5. It should be kept in mind that a typical ion funnel utilizes approximately one-hundred ring electrodes. For clarity, the accompanying drawings of ion funnels only depict a small portion of the total number of electrodes that are nearest to the exit aperture. The electrodes are electrically isolated from each other and radio-frequency (RF) voltages are applied to the electrodes in a prescribed phase relationship to radially confine the ions to the interior of the device. FIG. 1B is a schematic illustration of a possible configuration of each individual ring electrode, as exemplified by the first ring electrode 2*a*. Each ring electrode is formed as a plate, illustrated as plate 11*a* in FIG. 1B, that comprise a central aperture, illustrated as central aperture 8*a* having a respective aperture diameter, θ. Generally, the aperture diameters decrease along the length of the funnel in the direction of gas flow through the funnel. Each ring electrode may comprise one or more tabs, such tabs 9*a*, for mounting to a support structure (not shown) and possibly providing electrical connection to a power supply (not shown).

Although ion funnels are considered to be state-of-the-art, several limitations have been documented in the literature. Specifically, it has been found (Tolmachev, Aleksey V., Taeman Kim, Harold R. Udseth, Richard D. Smith, Thomas H. Bailey, and Jean H. Futrell. "Simulation-based optimization of the electrodynamic ion funnel for high sensitivity electrospray ionization mass spectrometry." International Journal of Mass Spectrometry 203, no. 1-3 (2000): 31-47) that transmission of low-mass ions (e.g., m/z<100) is inefficient due to poor stability, particularly in the region where the ratio of the aperture diameter (θ) to pitch (d) is ~2. Conversely, transmission of high-mass ions is limited by several factors including: (1) the inverse relationship between the radially-confining pseudopotential and m/z, (2) the drag force imparted by the gas flow, and (3) space charge effects, particularly in the region where the ion density increases near the output. These outcomes impose challenges when transmission of a wide m/z range is required, e.g., in a so-called "full-scan" MS-1 survey spectrum.

At the output of the ion funnel, a DC-only gas-conductance-limiting aperture having a diameter of ~2 mm is often employed. In this critical region (where θ/d≈2), the ion density increases and space charge can induce ion losses. Moreover, on-axis penetration of the RF voltage leads to the creation of axial trapping wells that can create instability, promote transient trapping, and leading to unwanted ion fragmentation. Such behavior is undesirable since such conditions also produce tuning curves where optimal transmission for a particular m/z can only be achieved within a narrow RF voltage range.

Tolmachev et al. describe an ion funnel design that decreases the axial RF voltage near the output via the addition of compensation electrodes. An alternative simple means to reduce the on-axis RF voltage is to simply increase the exit aperture size, although this modification is often not employed since it also increases the gas load on the downstream vacuum chambers in the mass spectrometer. Moreover, operation of the ion funnel with a high throughput ion inlet capillary (having a large internal bore, such as a slotted bore or, alternatively, multiple bores) results in elevated foreline pressure that further promotes transient trapping. Often, an axial "direct-current" (DC) voltage gradient is applied to promote ion transport through the critical region near the output.

SUMMARY

In accordance with the present teachings, alternative ion funnel designs are provided that are able to efficient transport ions without an applied DC gradient and without requiring additional gas pumping capacity. In particular, an optimized atmosphere-to-vacuum ion transport system in accordance with the present teachings includes: (a) an ion transfer tube interposed between an atmospheric-pressure ionization chamber and a partially evacuated chamber, the ion transfer tube; and (b) an ion funnel within the partially evacuated chamber, the ion funnel comprising a first funnel portion that comprises a plurality of plate electrodes configured as a stack, each electrode comprising an aperture having a respective aperture diameter, wherein each aperture diameter is greater than or equal to three times the inter-electrode pitch, wherein no DC electrical potential gradient is applied between an exit electrode and an adjacent one of the first plurality of plate electrodes.

The ion transfer tube may comprise a slotted bore or, alternatively may comprise a plurality of bores that are either slotted or round. Preferably, a longitudinal axis of the ion transfer tube is disposed at a non-zero angle relative to a central longitudinal axis of the ion funnel. According to various embodiments, the ion funnel may comprise a second funnel portion that is disposed between the first funnel portion and an ion tunnel that is configured to receive gas and charged particles from the ion transfer tube, wherein the second funnel portion comprises a second plurality of plate electrodes configured as a stack and wherein one or more of an inter-electrode pitch, an electrode thickness and a funnel half-axis differs or differ between the first and second funnel portions. Several embodiments meeting these specifications were found to result in superior transmission properties as described herein. Some embodiments of atmosphere-to-vacuum ion transport systems in accordance with the present teachings include ion funnels that further comprise an exit electrode having an aperture diameter of 2 mm or less. The improved experimental performance of the herein-described ion funnels is attributed to: (1) a decrease in on-axis RF voltage penetration and (2) a subsonic gas flow, substantially in the axial dimension, that emanates from the slotted-bore capillary and subsequent anisotropic supersonic expansion, that facilitates ion transport near the output of the funnel.

In order to provide increased gas and ion flow, some embodiments of atmosphere-to-vacuum ion transport systems in accordance with the present teachings may include an ion transfer tube comprising multiple slots, as described in commonly-assigned U.S. Pat. No. 8,309,916 and co-assigned U.S. Pat. No. 8,847,154 in the names of inventors Wouters et al. In some embodiments, the ion transfer tube may comprise multiple round or partially rounded bores, as described in commonly-assigned U.S. Pat. No. 7,470,899 (inventors, Atherton et al.) and commonly-assigned U.S. Pat. No. 8,847,154.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1A:
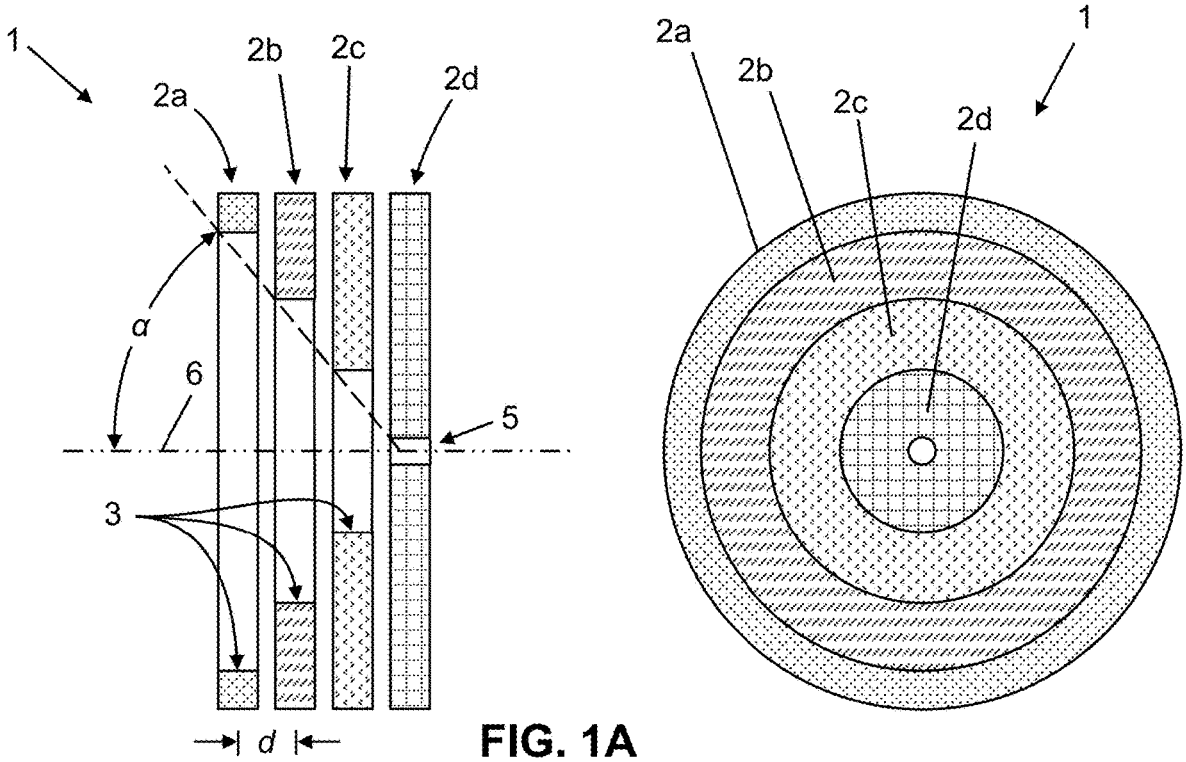
FIG. 1A (Prior Art)
FIG. 1A is set of schematic depictions of a portion of a conventional ion funnel, in both a longitudinal cross-sectional view (left-hand side) and an end-on view (right-hand side)
Figure 1B:
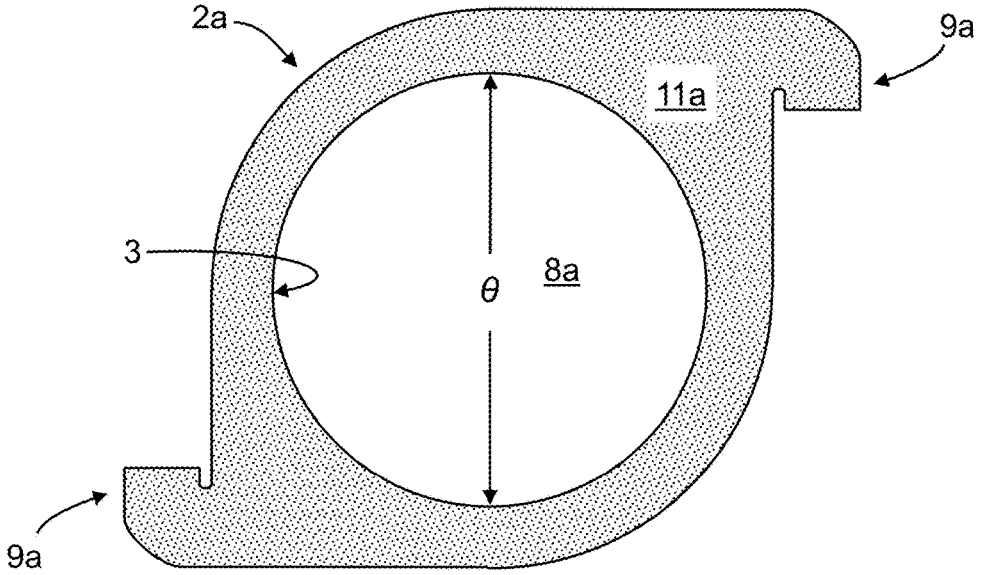
FIG. 1B (Prior Art)
FIG. 1B is a schematic illustration of one possible configuration of a plate electrode of an ion funnel.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1A-11F in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. As used herein, the term "DC", when referring to a voltage applied to one or more electrodes of a mass spectrometer component (such as an ion funnel), does not necessarily imply the imposition of or the existence of an electrical component through those electrodes but is used only to indicate that the referred-to applied voltage either is static or, if non-static, is non-oscillatory and non-periodic. The term "DC" is thus used herein to distinguish the referred-to voltage(s) from applied periodic oscillatory voltages, which themselves may be referred to as either "RF" or "AC" voltages.

Figure 2A:
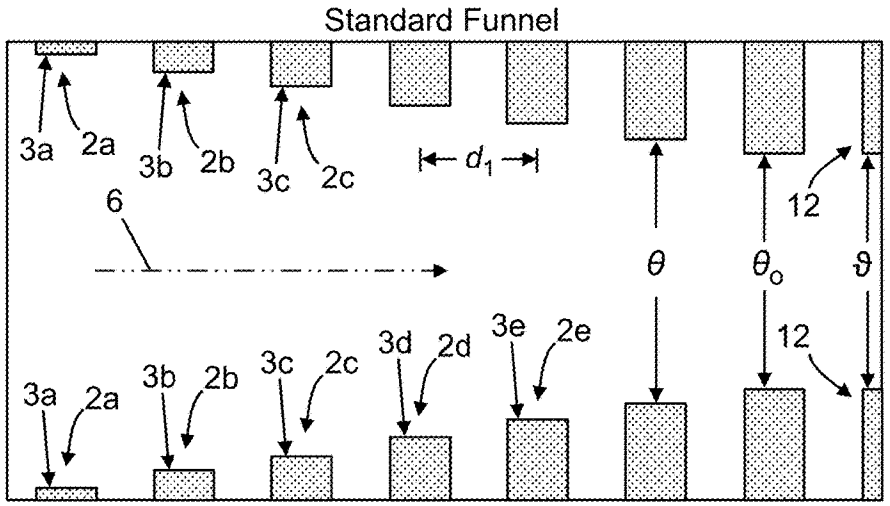
FIG. 2A is a second schematic longitudinal cross-sectional depiction of a portion of a conventional ion funnel.
Figure 2B:
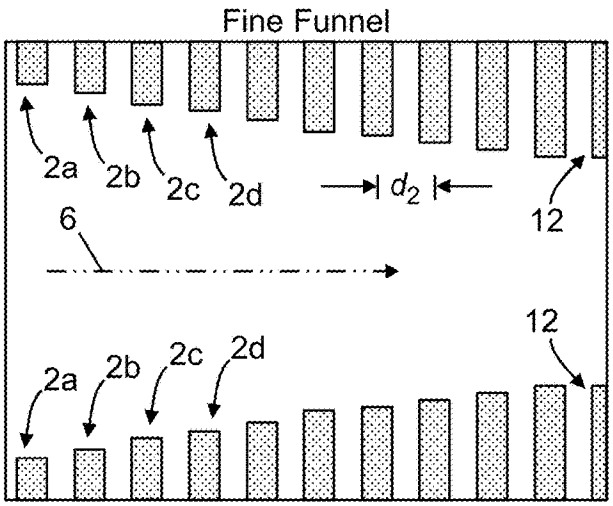
FIG. 2B is a schematic longitudinal cross-sectional view of a portion of a first ion funnel in accordance with the present teachings.
Figure 2C:
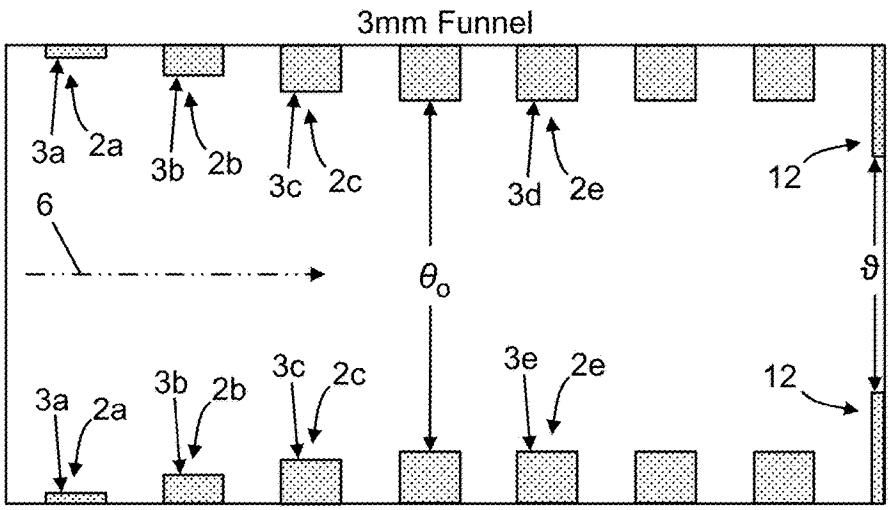
FIG. 2C is a schematic longitudinal cross-sectional view of a portion of a second ion funnel in accordance with the present teachings.
Figure 2D:
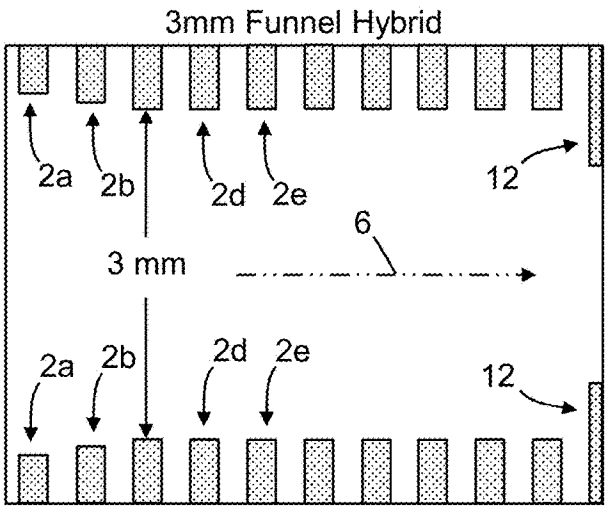
FIG. 2D is a schematic longitudinal cross-sectional view of a portion of a third ion funnel in accordance with the present teachings.

FIGS. 2B-2D depict alternative funnel designs in accordance with the present teachings that have different electrode geometries and that have been experimentally investigated by the inventors. FIG. 2A is another schematic longitudinal cross-section depiction of a portion of a conventional ion funnel (i.e., a "Standard Funnel") explicitly showing the definition of the dimensional parameters of pitch (e.g., pitch of numerical value, $d_1$), general variable aperture diameter, θ, and a minimum aperture diameter, $\theta_0$. Each of FIGS. 2A-2D schematically illustrates several plate electrodes 2*a*, 2*b*, 2*c*, etc., only a few of which are explicitly labeled in each figure. Note that support structures and electrical insulator structures are not depicted in these figures. Each plate electrode has an inner surface that defines an aperture, θ, of the electrode. The various inner surfaces are surfaces 3*a*, 3*b*, 3*c*, etc., only a few of which are explicitly labeled in each of FIGS. 2A-2D. The details of the designs are contained in Table 1.

Each ion funnel design comprises a central longitudinal axis, indicated at 6 in FIGS. 2A-2D. The arrow on the indicated axis 6 shows the direction of ion and gas flow under normal operation. In both the "Standard Funnel" (FIG. 2A) and the "Three

TABLE 1

Critical dimensions of three different embodiments of ion funnels ($\theta_0/d \geq 3$) compared to a standard ion funnel ($\theta_0/d = 2$).

| | Pitch (d), mm | Minimum Aperture Diameter ($\theta_0$), mm | $\theta_0/d$ |
|---|---|---|---|
| Standard Funnel | 1.00 | 2.00 | 2.00 |
| Fine Funnel | 0.50 | 2.00 | 4.00 |
| 3 mm Funnel | 1.00 | 3.00 | 3.00 |
| Fine funnel/3 mm Funnel Hybrid | 0.50 | 3.00 | 6.00 |

-Millimeter Funnel (FIG. 2C), the value of the inter-electrode pitch is $d_1$=1 mm. In both the "Fine Funnel" (FIG. 2B) and the "Fine Funnel/3 mm Funnel Hybrid" (FIG. 2D), the pitch is set at $d_2$=0.5 mm. The aperture diameter, θ, uniformly decreases to its minimum value, $\theta_0$, which is at the exit aperture, in the direction of ion flow within at least a downstream portion of each of the Standard Funnel (FIG. 2A) and the Fine Funnel (FIG. 2B). In both the Three-Millimeter Funnel (FIG. 2C) and the Hybrid Funnel (FIG. 2D), there is a portion of the length of the funnel within which the aperture diameter, θ, decreases in the direction of flow, e.g., a decrease in θ from a maximum value at an entrance aperture to a minimum value, $\theta_0$, of 3 mm, after which the aperture diameters do not further decrease, with the exception of the aperture of an exit electrode 12. Thus, each of the Three-Millimeter Funnel and the Hybrid Funnel comprises a downstream "ion tunnel" portion (separate and distinct from the "upstream" ion tunnel portion 201 depicted in FIG. 4 and discussed below), at which the aperture diameters of adjacent plate electrodes remain constant at 3.00 mm. The aperture diameter of the exit electrode 12 is maintained at a constant value of ϑ for all funnel embodiments described herein, where ϑ=2 mm, thereby maintaining the gas-flow restriction of the conventional ion funnel. In alternative funnel designs, the diameter of the exit electrode could be different from this value, e.g., for the purpose or more-accurately regulating flow of gas into a downstream chamber.

Is should be noted that several aspects of the depictions of funnel cross sections in FIGS. 2A-2D are schematic. For example, the number of plate electrodes within each funnel, the thickness of the electrodes, and the size relationship, if any, between electrode thickness and pitch may vary from the numbers, thicknesses and relative dimensions shown in FIGS. 2A-2D. Likewise, the rate of change of the aperture diameter, θ, with changing position along the central funnel axis 6 may differ from what is shown in those figures. Further, each one of the illustrated funnel designs may include one or more additional portions or segments that are upstream, with respect to the flow of gas through the funnel, from the depicted funnel portion and that comprise electrode configurations that differ from the illustrated configuration. As but one example, either the Fine Funnel or the Fine Funnel Hybrid could, in certain variations, be embodied to have an upstream funnel portion that has an inter-electrode pitch that is different from the inter-electrode pitch of the funnel portion illustrated the respective drawing figure. For example, in either of these cases, the upstream portion could have the same pitch as the Standard Funnel. Alternatively, any of the illustrated or discussed funnel designs could include an upstream portion having a different funnel half-angle, α, or a different electrode thickness than illustrated in the figures. All such variations are considered to be within the scope of the claimed invention.

Figure 3A:
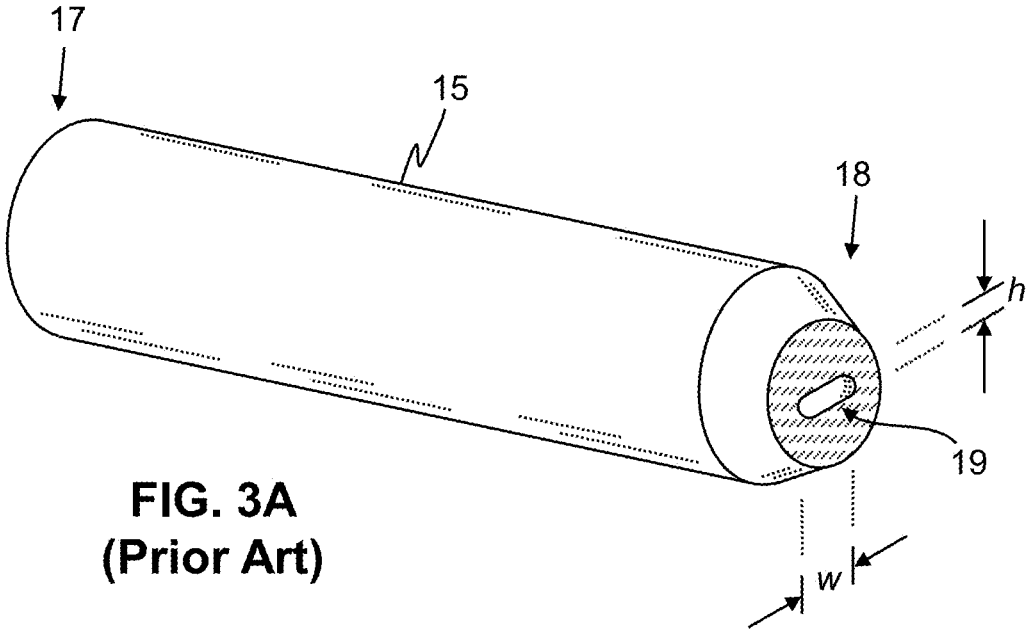
FIG. 3A (Prior Art)
FIG. 3A is a schematic perspective view of a known ion transfer tube having a slotted bore.

In the investigations described herein, ions were transferred into the funnels through an ion transfer tube (e.g., a capillary) tube 15 (FIG. 3A) having a slotted internal bore 19 having a non-circular cross section passing completely therethrough. As noted above, some embodiments of atmosphere-to-vacuum ion transport systems in accordance with the present teachings may include an ion transfer tube comprising multiple slots or an ion transfer tube comprising multiple round or partially rounded bores. As shown, the slotted bore 19 comprises a longitudinal dimension, labeled w, and a transverse dimension, h, where w>h. The ion transfer tube 15 comprises an inlet end 17 which, in operation, receives a mixture of gas, charged droplets, and solvated and unsolvated ions from an ion source (not shown) that may be an electrospray, thermospray or atmospheric-pressure chemical ionization (APCI) source. A heater (not shown) in thermal contact with the ion transfer tube provides thermal energy that causes evaporation of solvent from droplets and desolvation of solvated ions during their passage through the slotted bore 19. As noted in U.S. Pat. No. 8,309,916, which is incorporated herein by reference in its entirety, an ion transfer tube as illustrated in FIG. 3A has an improved ability to transfer heat to entrained charged particles without adversely affecting total flow rate through the tube.

Figure 3B:
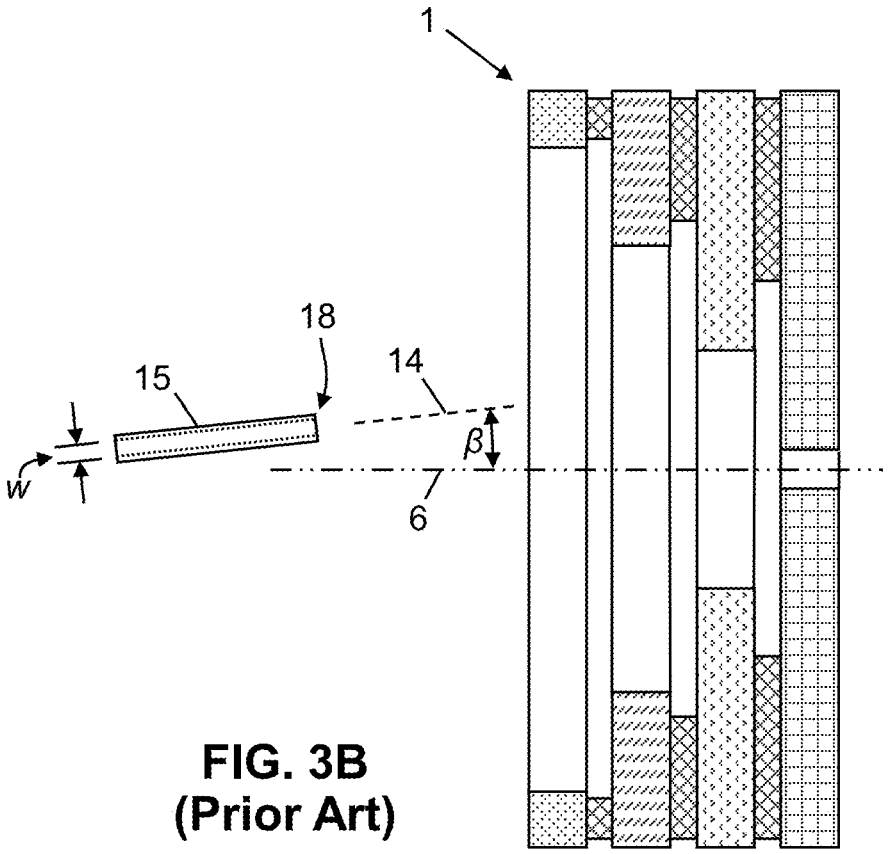
FIG. 3B (Prior Art)
FIG. 3B is a schematic depiction of a preferred disposition of a slotted ion transfer tube relative to a central axis of an ion funnel.

FIG. 3B illustrates a preferred configuration, as described in U.S. Pat. No. 9,761,427, of a slotted ion transfer tube 15 relative to the central axis 6 of an ion funnel that receives ions from the ion transfer tube 15. In the illustrated preferred configuration, the longitudinal axis 14 of the ion transfer tube 15 is disposed at an angle, β, relative to the central axis 6 of the ion funnel. Preferably, the ion transfer tube is further disposed such that the long dimension of the slot 19 is disposed parallel to the plane between tube axis 14 and funnel axis 6. For example, all experimental mass spectrometric data described in this document were obtained using a mass spectrometer that included an ion transfer tube oriented, relative to an ion funnel, as shown in FIG. 3B, with β≈1.5 degrees.

Figure 4:
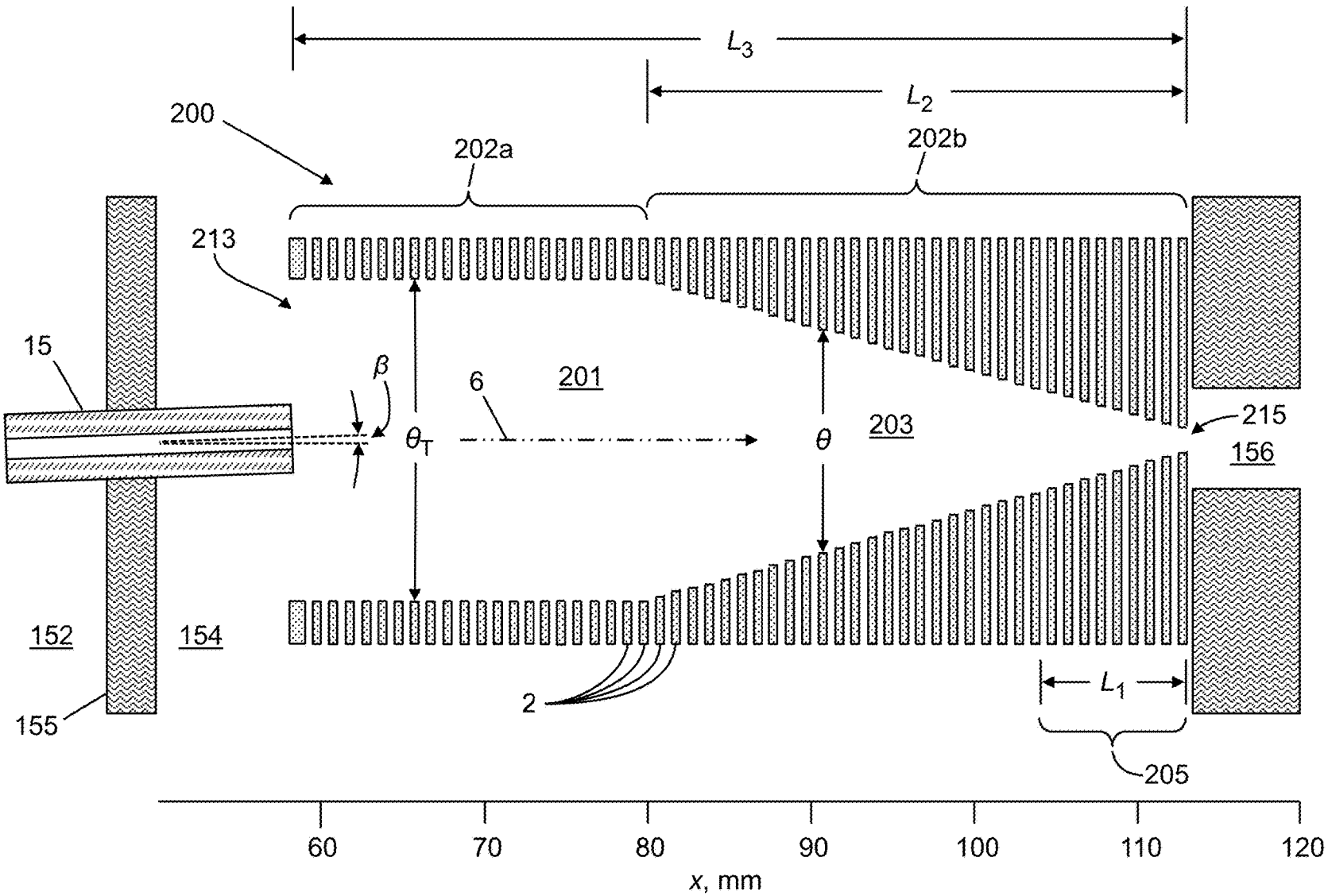
FIG. 4 is a schematic depiction of an ion transfer apparatus that includes an ion funnel.
Figure 5A:
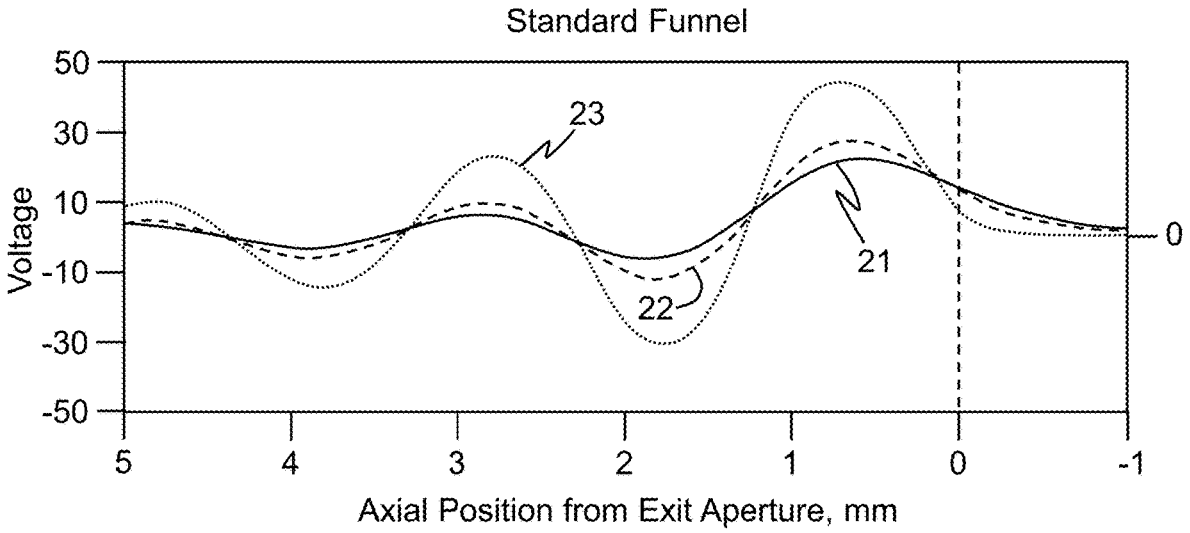
FIG. 5A is a set of graphical plots of radio-frequency (RF) voltage penetration within a conventional ion funnel along the central longitudinal axis and at radial distances of 0.5 mm and 0.9 mm from the central longitudinal axis.
Figure 5B:
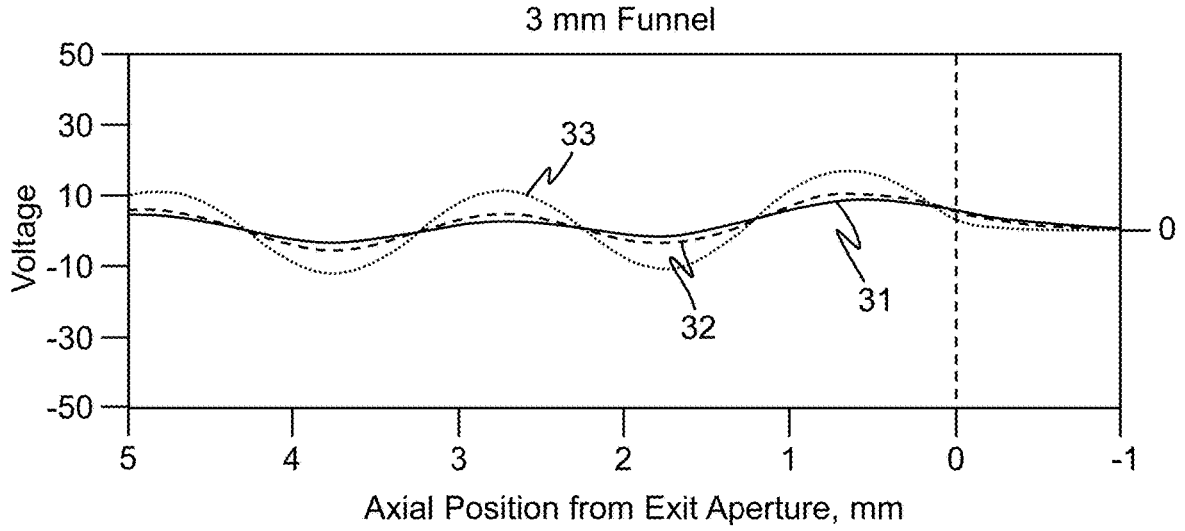
FIG. 5B is a set of graphical plots of radio-frequency (RF) voltage penetration within a first ion funnel having a set of enlarged apertures in accordance with the present teachings, the plots taken along the central longitudinal axis and at radial distances of 0.5 mm and 0.9 mm from the central longitudinal axis.
Figure 5C:
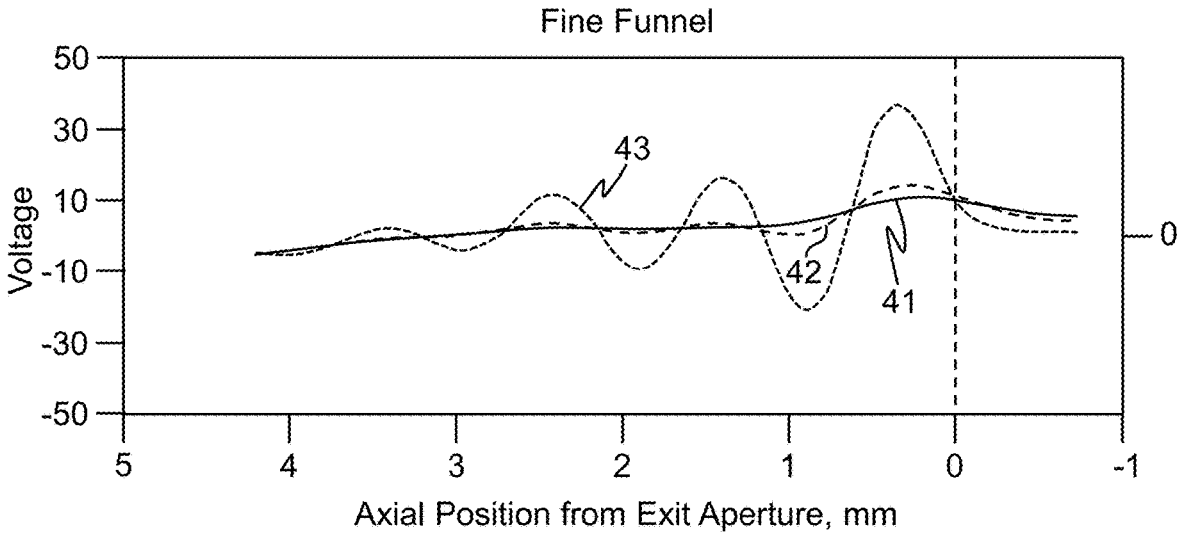
FIG. 5C is a set of graphical plots of radio-frequency (RF) voltage penetration within a second ion funnel having reduced inter-electrode pitch in accordance with the present teachings, the plots taken along the central longitudinal axis and at radial distances of 0.5 mm and 0.9 mm from the central longitudinal axis.
Figure 5D:
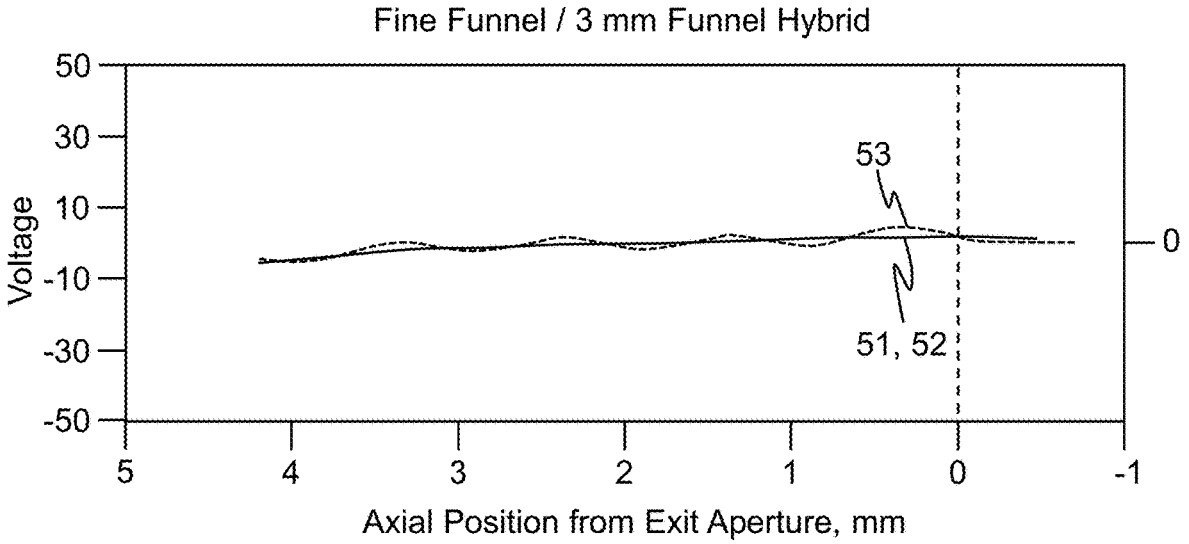
FIG. 5D is a set of graphical plots of radio-frequency (RF) voltage penetration within a third ion funnel having both reduced inter-electrode pitch and enlarged electrode apertures in accordance with the present teachings, the plots taken along the central longitudinal axis and at radial distances of 0.5 mm and 0.9 mm from the central longitudinal axis.

FIG. 4 is a schematic depiction of an ion transfer apparatus 200 of length $L_3$ that includes an ion funnel portion 203 of length $L_2$ as well as an ion tunnel portion 201 of length $L_3$-$L_2$. Note that the ion funnel cross section depicted in FIG. 2A is a portion of the length of the ion transfer apparatus 200 that is adjacent to an exit aperture 215. Likewise, note that the cross sections depicted in FIGS. 2B-2D are novel modified versions of a portion 205, of variable length, $L_1$, of the length of the ion transfer apparatus 200 that is adjacent to the exit aperture 215. A plurality of ring electrodes 2 comprise apertures that define the ion tunnel and ion funnel portions. The ion tunnel portion 201 of the ion transfer apparatus receives, through an entrance aperture 213, a mixture of gas and ions from an ion transfer tube 15 that transfers the mixture from an ionization chamber 152 into a reduced-pressure chamber 154 that contains the apparatus 200. A partition 155 separates the chamber 152, which is at approximately atmospheric pressure, from the chamber 154, which is maintained at a pressure within the general range of 1-10 Torr. The ion transfer apparatus 200 transports the ions to a high-vacuum chamber 156 through an exit aperture 215 while, at the same time, exhausting most of the gaseous molecules through the gaps between the ring electrodes 2.

A first set 202*a* of the ring electrodes 2 comprise a common, constant aperture diameter, $\theta_T$. A first one of these apertures is the entrance aperture 213. The diameter $\theta_T$ is sufficiently large to contain the expansion plume of gas and ions that emerges at high velocity from the ion transfer tube 15. A second set 202*b* of the electrodes comprise apertures of variable diameter θ, which progressively decrease along the length, $L_2$, of the funnel portion 203 with increasing proximity to the exit aperture 215 of the apparatus. The second set 202*b* of electrodes focus the ions into a narrow beam the passes through the exit aperture 215 and into the high-vacuum chamber 156.

Table 2, below, lists the experimental conditions that were employed while simulating and testing the various funnel configurations, the results of which are described in the following paragraphs. The "slot length" field refers to size of slot of ion transfer tube 15 that was used as an inlet to funnel. The "length" field refers to the full length of the stacked ring apparatus, as shown in FIG. 4, from the entrance aperture to the exit aperture. The listed pressures were experimentally measured outside of the funnel electrodes.

TABLE 2

Experimental conditions employed.

| Slot length (mm) | Pressure, P (Torr) | Gas pumping speed, S ($m^3$/hr) | Entrance Aperture, $\theta_T$ (mm) | Length, $L_3$ (mm) | Throughput (=S × P) |
|---|---|---|---|---|---|
| 1.6 | 1.7 | 200 | 20 | 54 | 340 |
| 1.6 | 3.6 | 94 | 20 | 54 | 340 |
| 1.2 | 1.4 | 200 | 20 | 54 | 280 |
| 1.2 | 3.6 | 78 | 20 | 54 | 280 |

FIGS. 5A-5D are plots of the calculated RF voltage penetration, as calculated for one of the two RF phases, within the various ion funnels (FIGS. 2A-2D) either on the central longitudinal axis 6 or at a specific distance outward from the axis along a radius. In all cases, an RF voltage of 50 V (peak-to-peak) was applied to the funnel electrodes. The results illustrated in FIGS. 5A-5D were calculated using SIMION™ electric field and charged-particle trajectory modeling software that is commercially available from Adaptas S.I.S. of Ringoes, N.J., USA. Solid line curves 21, 31, 41 and 51 represent the on-axis RF voltage penetration, calculated as described above, in the Standard Funnel Three-Millimeter Funnel, Fine Funnel and Hybrid Funnel, respectively. Dashed line curves 22, 32, 42 and 52 represent RF voltage penetration, calculated as described above, at 0.5 mm from the axis in the Standard Funnel Three-Millimeter Funnel, Fine Funnel and Hybrid Funnel, respectively. Finally, dotted line curves 23, 33, 43 and 53 represent RF voltage penetration, calculated as described above, at 0.9 mm from the axis in the Standard Funnel Three-Millimeter Funnel, Fine Funnel and Hybrid Funnel, respectively. The data indicate that voltage penetration on-axis is significant in the standard funnel design (22 V max) which increases significantly off-axis. The axial voltage profile ultimately results in a series of pseudopotential wells, the magnitude of which is proportional to the voltage squared. The depth of the pseudo-potential well is inversely proportional to m/z in accordance with M. Yavor's monograph (Yavor, Mikhail.

*Optics of charged particle analyzers*. San Diego, Calif.: Academic Press, 2009). When the pitch is reduced by a factor of 2, as in the Fine Funnel (FIG. 5C), the on-axis voltage penetration decreases by about one-half (10.7 V max). Alternatively, when the maximum aperture diameter is increased from 2 to 3 mm (while maintaining constant pitch, as in the Three-Millimeter Funnel, FIG. 5B), the on-axis voltage is decreased to a greater extent (8.7 V max). Finally, when the pitch and diameter are changed together, as in the Hybrid Funnel (FIG. 5D), the voltage both on- and off-axis is significantly reduced (4.2 V max).

Figure 6A:
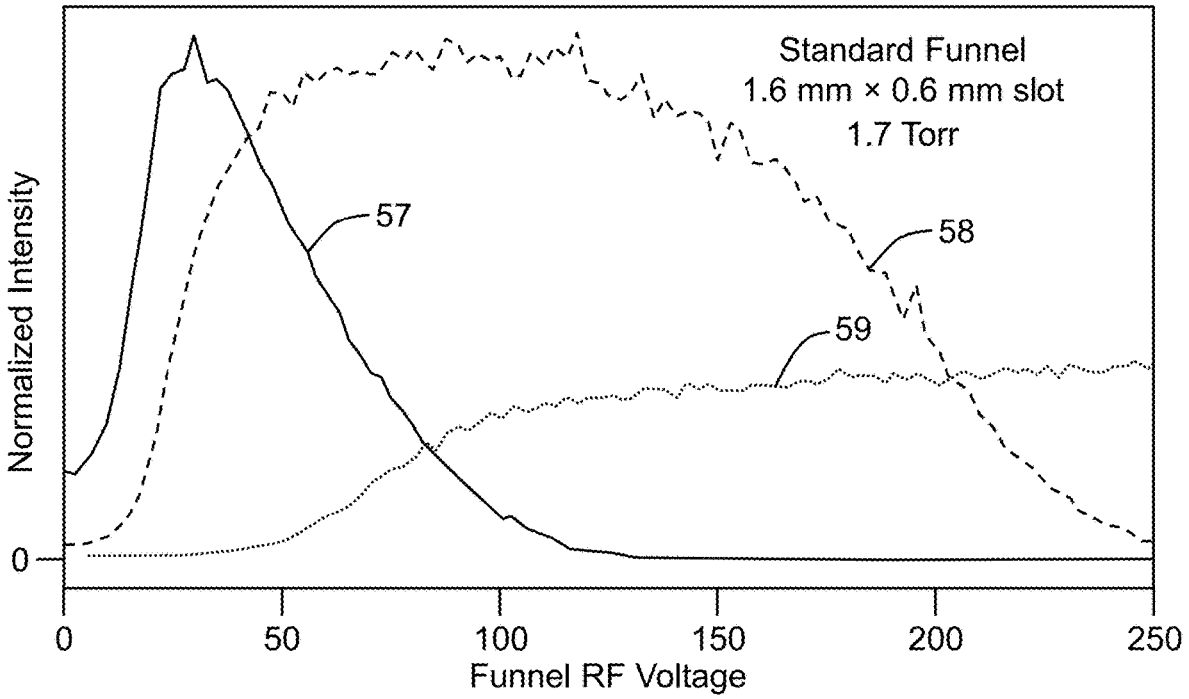
FIG. 6A is a set of plots of the observed mass spectral intensity of n-Butylamine (mass-to-charge ratio of singly charged ion: 74.10 Th), caffeine (mass-to-charge ratio of singly charged ion: 195.09 Th) and the standard fluorinated phosphazine calibrant compound $C_{26}H_{19}O_6N_3P_3F_{40}$ (mass-to-charge ratio: 1321.98 Th) versus RF voltage as measured by a mass spectrometer equipped with a Standard Funnel, as defined herein, receiving ions from a 1.6 mm×0.6 mm slot of an ion transfer tube, the Standard Funnel maintained at a pressure of 1.7 Torr.
Figure 6B:
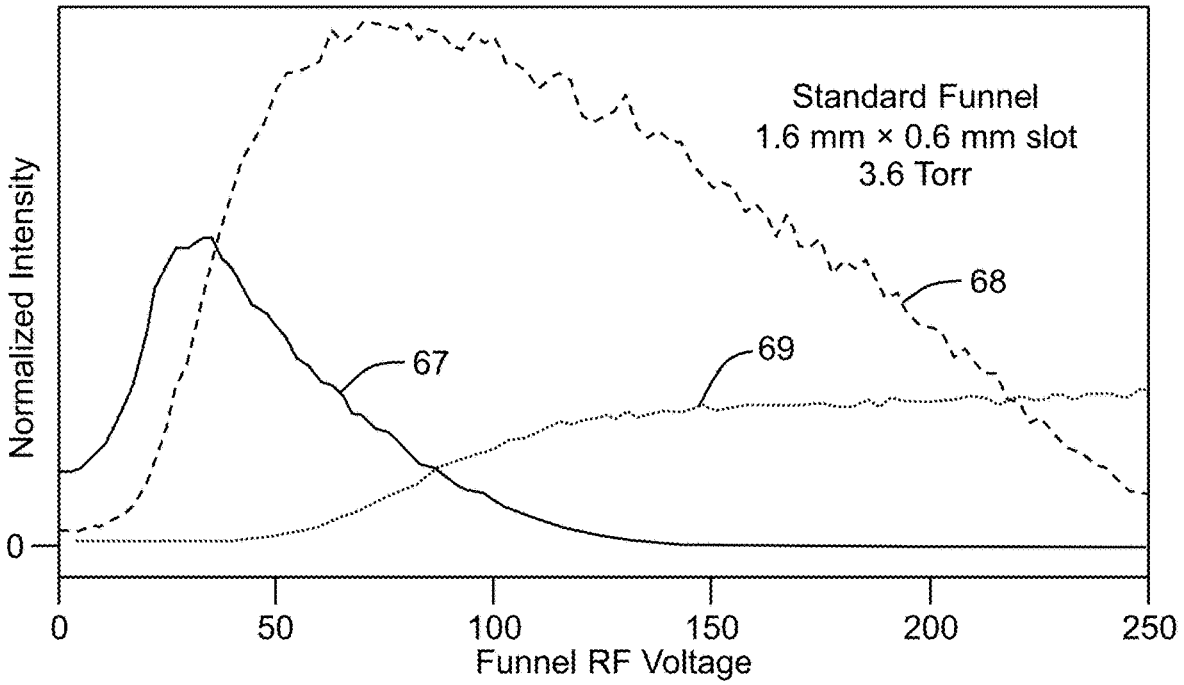
FIG. 6B is a set of plots of the observed mass spectral intensity of n-Butylamine, caffeine and $C_{26}H_{19}O_6N_3P_3F_{40}$ versus RF voltage as measured by a mass spectrometer equipped with a Standard Funnel, as defined herein, receiving ions from a 1.6 mm×0.6 mm slot of an ion transfer tube and maintained at a pressure of 3.6 Torr.
Figure 6C:
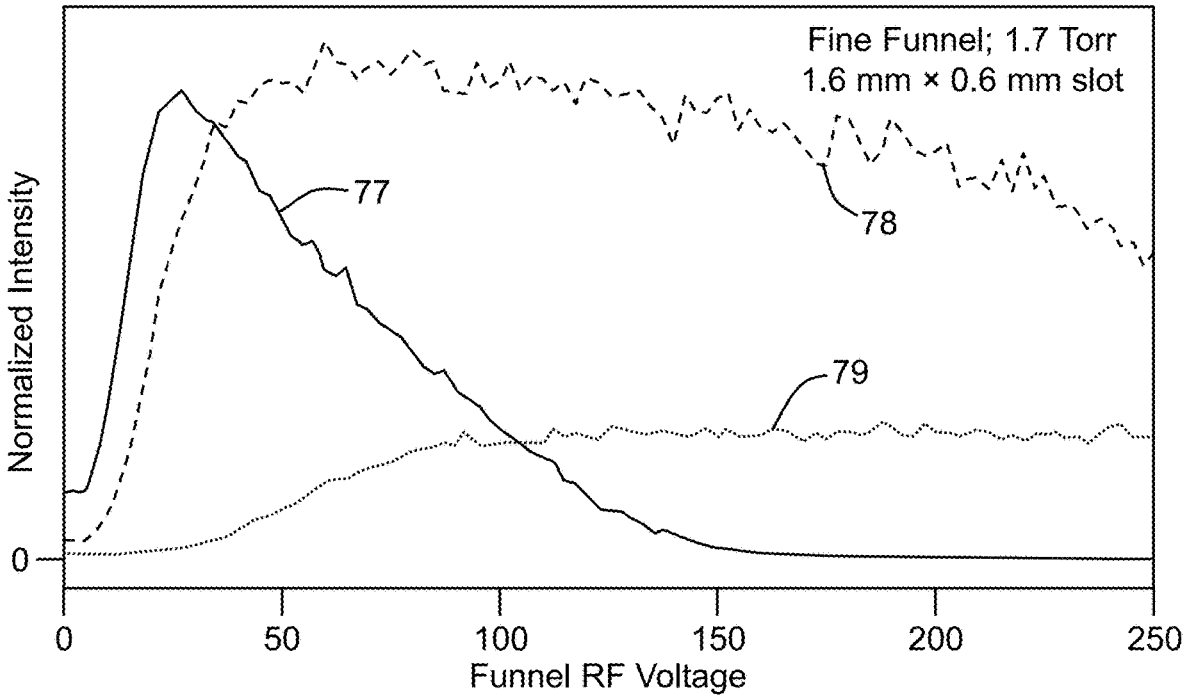
FIG. 6C is a set of plots of the observed mass spectral intensity of n-Butylamine, caffeine and $C_{26}H_{19}O_6N_3P_3F_{40}$ versus RF voltage as measured with a mass spectrometer equipped with a Fine Funnel, as defined herein, receiving ions from a 1.6 mm×0.6 mm slot of an ion transfer tube and maintained at a pressure of 1.7 Torr.
Figure 6D:
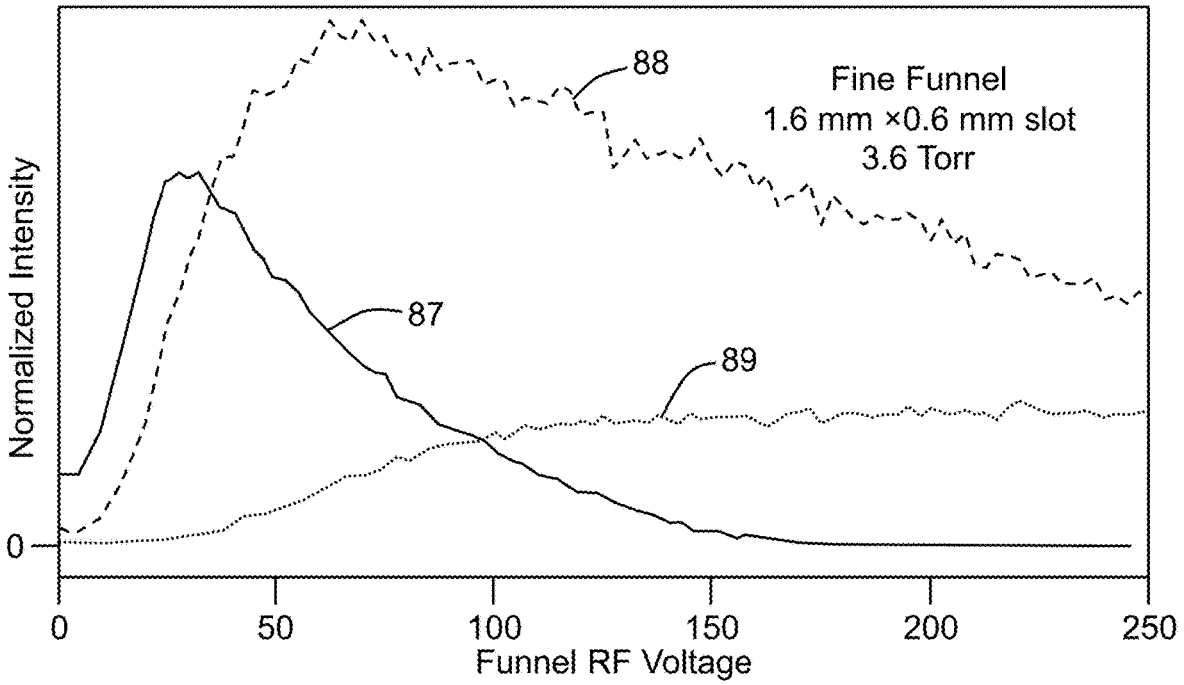
FIG. 6D is a set of plots of the observed mass spectral intensity of n-Butylamine, caffeine and $C_{26}H_{19}O_6N_3P_3F_{40}$ versus RF voltage as measured with a mass spectrometer equipped with a Fine Funnel, as defined herein, receiving ions from a 1.6 mm×0.6 mm slot of an ion transfer tube and maintained at a pressure of 3.6 Torr.
Figure 7A:
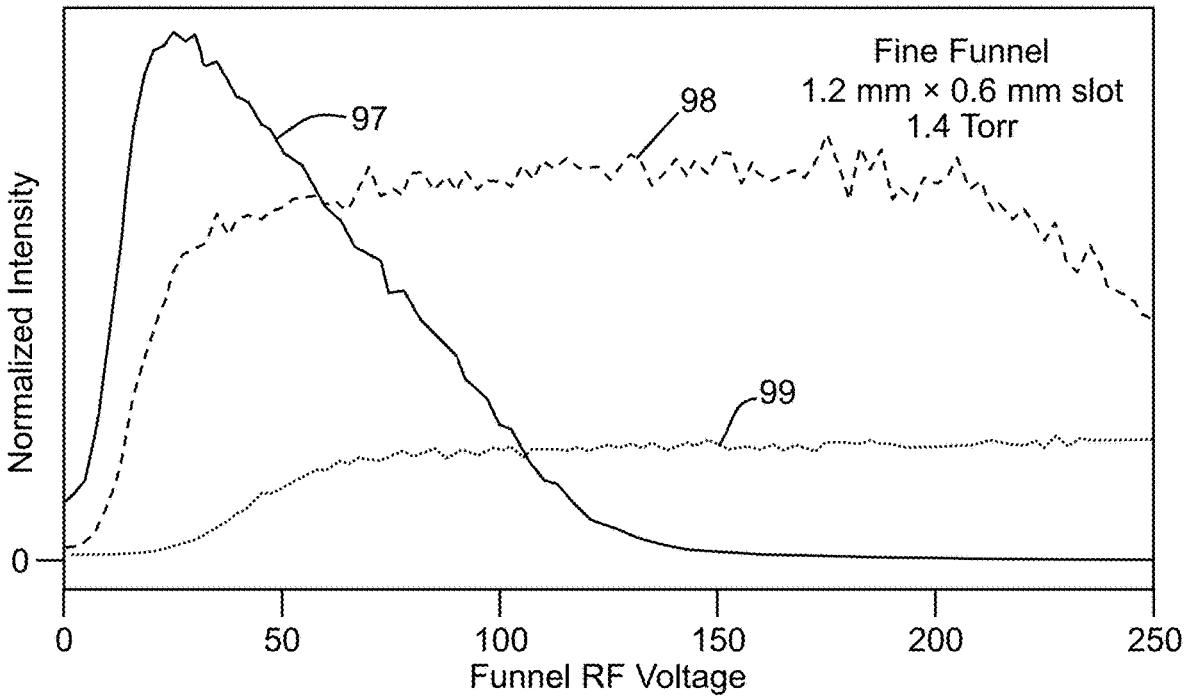
FIG. 7A is a set of plots of the observed mass spectral intensity of n-Butylamine, caffeine and $C_{26}H_{19}O_6N_3P_3F_{40}$ versus RF voltage as measured by a mass spectrometer equipped with a Fine Funnel, as defined herein, receiving ions from a 1.2 mm×0.6 mm slot of an ion transfer tube and maintained at a pressure of 1.4 Torr.
Figure 7B:
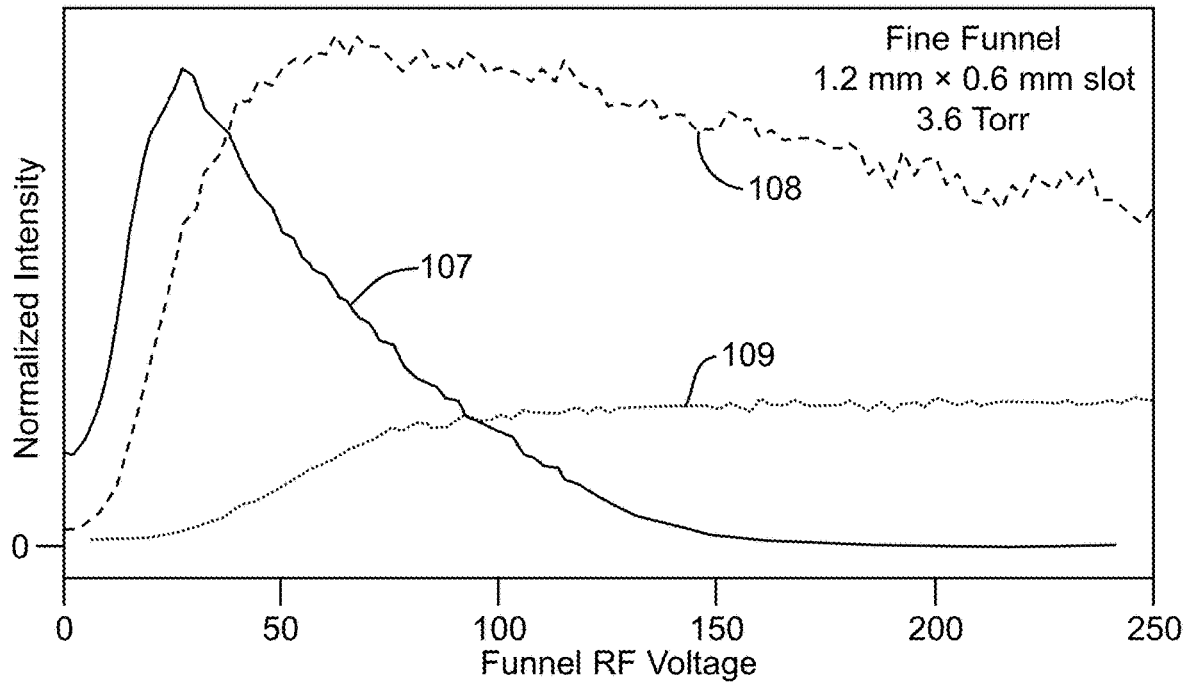
FIG. 7B is a set of plots of the observed mass spectral intensity of n-Butylamine, caffeine and $C_{26}H_{19}O_6N_3P_3F_{40}$ versus RF voltage as measured by a mass spectrometer equipped with a Fine Funnel, as defined herein, receiving ions from a 1.2 mm×0.6 mm slot of an ion transfer tube and maintained at a pressure of 3.6 Torr.

FIGS. 6A-6D and 7A-7B are plots of the normalized observed mass spectral intensity, versus funnel RF voltage, of n-Butylamine (mass-to-charge ratio of singly charged ion: 74.10 Th), caffeine (mass-to-charge ratio of singly charged ion: 195.09 Th) and the standard fluorinated phosphazine calibrant compound $C_{26}H_{19}O_6N_3P_3F_{40}$ (mass-to-charge ratio of 1321.98 Th), as obtained using various ion inlet and funnel configurations. These compounds are all constituents of the Pierce™ LTQ™ Velos™ ESI Positive Ion Calibration Solution (available from Thermo Fisher Scientific of Waltham, Mass.) and were analyzed simultaneously and together with the remaining constituents of that calibration solution (only selected results shown). FIGS. 6A-6D relate to funnels receiving ions from an ion transfer tube having a 1.6 mm×0.6 mm slotted bore, with FIGS. 6A and 6B relating to a Standard Funnel maintained at 1.7 Torr and 3.6 Torr, respectively, and FIGS. 6C and 6D relating to a Fine Funnel at 1.7 Torr and 3.6 Torr, respectively. FIGS. 7A-7B relate to a Fine Funnel receiving ions from an ion transfer tube having a smaller slotted bore (i.e., 1.2 mm×0.6 mm), with the funnel maintained at 1.4 Torr and 3.6 Torr, respectively. Solid-line curves 57, 67, 77, 87, 97 and 107 relate to the observed mass spectral intensity of n-Butylamine; dashed-line curves 58, 68, 78, 88, 98 and 108 relate to the observed mass spectral intensity of caffeine; finally, dotted-line curves 59, 69, 79, 89, 99 and 109 relate to the observed mass spectral intensity of $C_{26}H_{19}O_6N_3P_3F_{40}$.

Several effects are apparent from the results depicted in FIGS. 6A-6D and 7A-7B. Irrespective of the funnel design, it is found that, as pressure increases, the signal attributable to the low m/z ion species of n-butylamine decreases. This effect is, in part, attributed to general instability of low m/z species in the axial traps, both in terms of ion motion and susceptibility to undesired "in-source" fragmentation. It is believed that increasing pressure causes collisional dampening of ion motion that promotes transient trapping and, consequently, fragmentation. Both ion trapping and fragmentation lead to an overall loss in transmission. Gas dynamics can also play an important role in ion transmission. For example, data acquired using the ion transfer tube capillary the shorter slot length (1.2 mm) results in enhanced signal of the low m/z ion of n-butylamine relative to the data acquired using the ion transfer tube capillary having the 1.6 mm slot. This effect is illustrated by comparison of curves 77 and 87 to curves 97 and 107, respectively, all of which were obtained using the Fine Funnel. This result is attributed to reduced lateral flare of the gas expansion emerging from the shorter slot. The lower the m/z of an ion species, the closer is its trajectory to the gas streamlines. When the slot length of the ion transfer is longer, more of the gas flux exits through the final slots of the funnel, taking the lower-m/z ions out of the funnel before they reach the exit aperture. As another example, calculations of internal funnel pressure within the Fine Funnel indicate that the internal pressure in the area of last 2-3 apertures exceeds the downstream from the funnel by greater than fifty percent, with a consequent increase in gas velocity out of the funnel. Thus, the collective data suggest that reducing the height of the internal axial pseudo-potential wells, relative to the Standard Funnel, and providing additional axial force near the funnel axis is beneficial for low mass (m/z<100) transmission.

Evidenced by the caffeine traces, the Fine Funnel and the Three-Millimeter Funnel provide improved transmission across the entire operational voltage range, relative to transmission through the Standard Funnel. This is the result of the reduction in on-axis field penetration which principally affects the transmission. This improved transmission is especially clear when examining the transmission at high RF voltage (~250 $V_{pp}$) which is less than 10% using the standard funnel as compared to greater than 50% using the fine pitch funnel. Moreover, the data depicted in FIGS. 6A-6D and FIGS. 7A-7B demonstrate that reducing the slot length of the ion transfer tube inlet further expands the operational voltage range.

Dotted-line curves 59, 69, 79, 89, 99 and 109 relate to the fluorinated phosphazine calibrant compound $C_{26}H_{19}O_6N_3P_3F_{40}$ (m/z=1321.98) which is one of the Ultramark 1621 series of mass spectrometric calibrant compounds (Moini, Mehdi. "Ultramark 1621 as a calibration/reference compound for mass spectrometry. II. Positive- and negative-ion electrospray ionization." *Rapid Communications in Mass Spectrometry* 8, no. 9 (1994): 711-714). The full set of Ultramark 1621 compounds are included within the Pierce™ LTQ™ Velos™ ESI Positive Ion Calibration Solution that was employed for the present studies. In order to avoid clutter, only the results for $C_{26}H_{19}O_6N_3P_3F_{40}$ are depicted in the graphs; the trends for the remaining Ultramark 1621 compounds are similar. By comparison of either FIG. 6A with FIG. 6C or FIG. 6B with FIG. 6D, it is readily apparent that, regardless of pressure within the investigated range, when the Standard Funnel is replaced by the Fine Funnel, both the voltage corresponding to the low-voltage transmission onset and the voltage corresponding to the attainment of the maximum transmission plateau of the Ultramark series are shifted to lower values. A similar conclusion may be reached by either comparing trace 59 of FIG. 6A with trace 99 of FIG. 7A or comparing trace 69 of FIG. 6B with trace 109 of FIG. 7B. Although FIGS. 7A-7B pertain to results obtained using a different ion transfer tube than the ion transfer tube used in the generation of the data of FIGS. 6A-6B, the accompanying fluid dynamic changes are not believed to significantly affect the transmission of the Ultramark ion species, as all of these species have m/z values greater than 1000 Th.

Figure 7C:
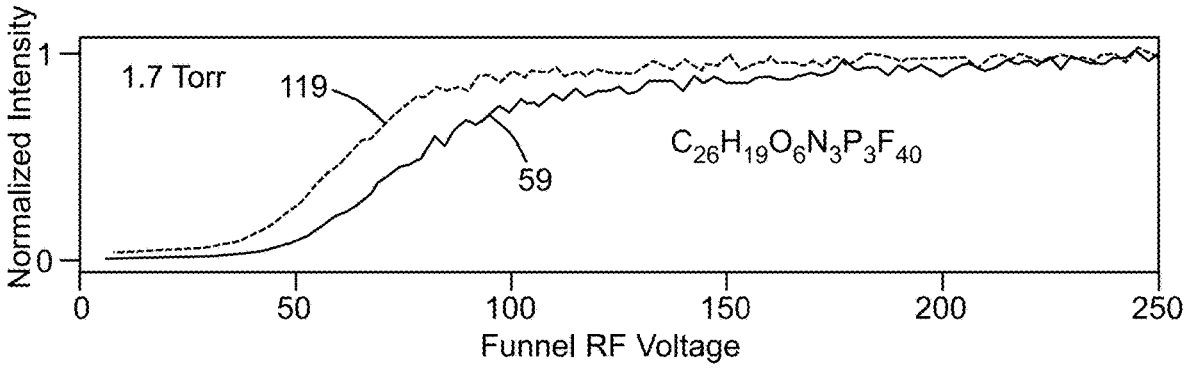
FIG. 7C is a set of plots of the observed intensity of the standard fluorinated phosphazine calibrant compound $C_{26}H_{19}O_6N_3P_3F_{40}$ versus RF voltage as measured by a mass spectrometer equipped with a Three-Millimeter Funnel and by a mass spectrometer equipped with a Standard Funnel, both as defined herein and maintained at 1.7 Torr, the Three-Millimeter Funnel receiving ions emitted from a 1.2 mm×0.6 mm ion transfer tube slot and the Standard Funnel receiving ions from a 1.6 mm×0.6 mm ion transfer tube slot.
Figure 7D:
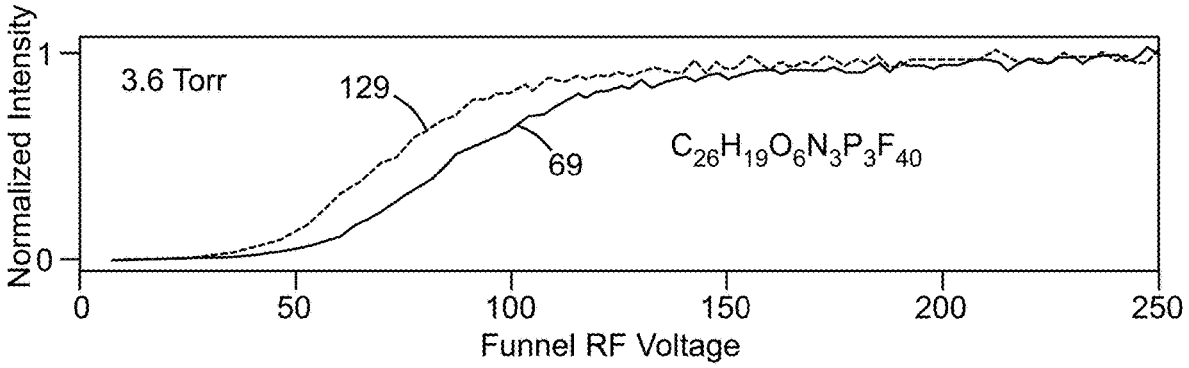
FIG. 7D is a set of plots of the observed intensity of the standard fluorinated phosphazine calibrant compound $C_{26}H_{19}O_6N_3P_3F_{40}$ versus RF voltage as measured by a mass spectrometer equipped with a Three-Millimeter Funnel and by a mass spectrometer equipped with a Standard Funnel, both as defined herein and maintained at 3.6 Torr, the Three-Millimeter Funnel receiving ions emitted from a 1.2 mm×0.6 mm ion transfer tube slot and the Standard Funnel receiving ions from a 1.6 mm×0.6 mm ion transfer tube slot.
Figure 8A:
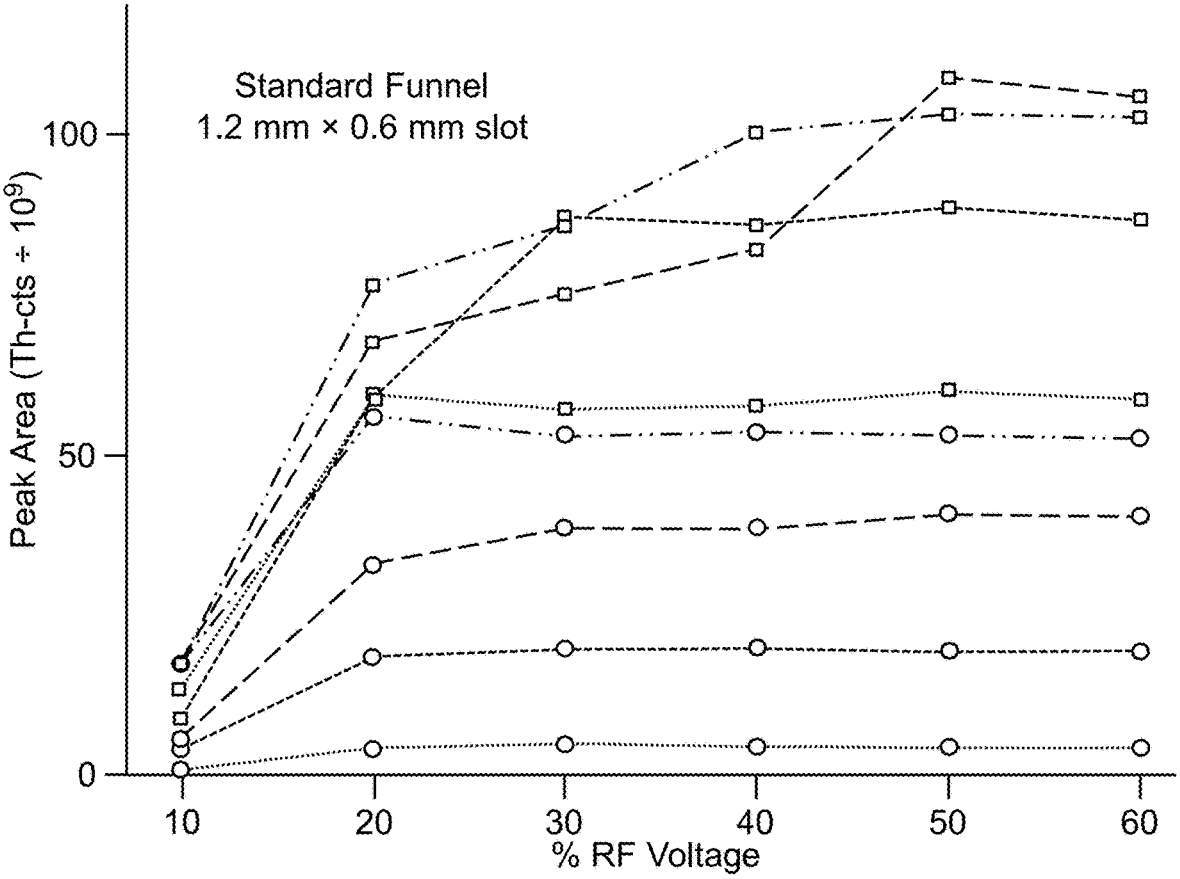
FIG. 8A is a set of graphical plots of the variation of measured abundances, with respect to applied RF voltage, of selected tryptic peptides from a HeLa protein cell digest (hereinafter referred to as "HeLa peptide") precursor ions, as measured by a mass spectrometer equipped with a Standard Funnel, as defined herein, the ion funnel receiving ions from a 1.2 mm×0.6 mm slot of an ion transfer tube and housed within a chamber maintained at a pressure of 1.4 Torr.
Figure 8B:
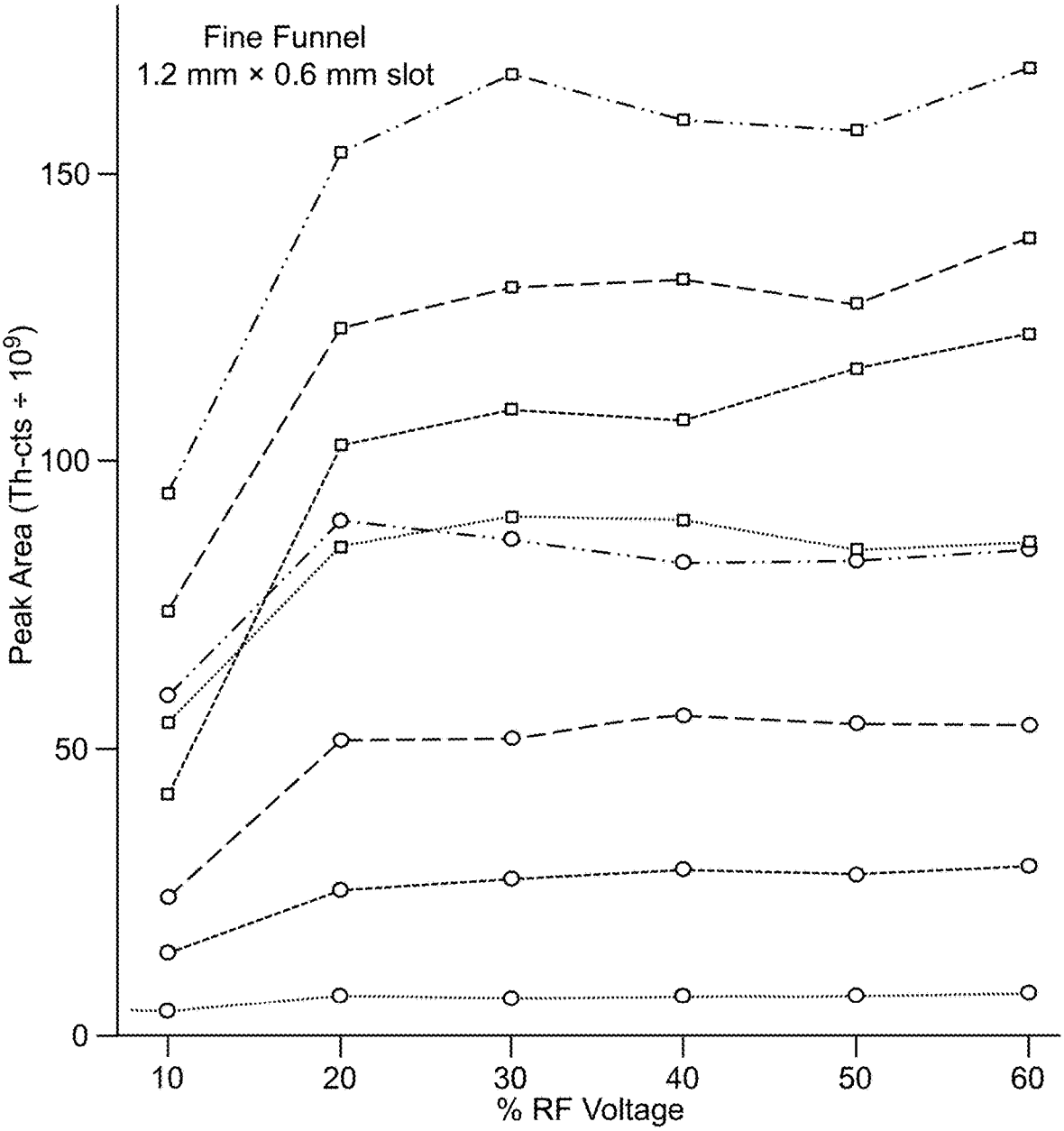
FIG. 8B is a set of graphical plots of the variation of measured abundances, with respect to applied RF voltage, of the selected tryptic HeLa peptide precursor ions referenced in the caption to FIG. 8A, as measured by a mass spectrometer equipped with a Fine Funnel, as defined herein and in accordance with the present teachings, the ion funnel receiving ions from a 1.2 mm×0.6 mm slot of an ion transfer tube and housed within a chamber maintained at a pressure of 1.4 Torr.
Figure 8C:
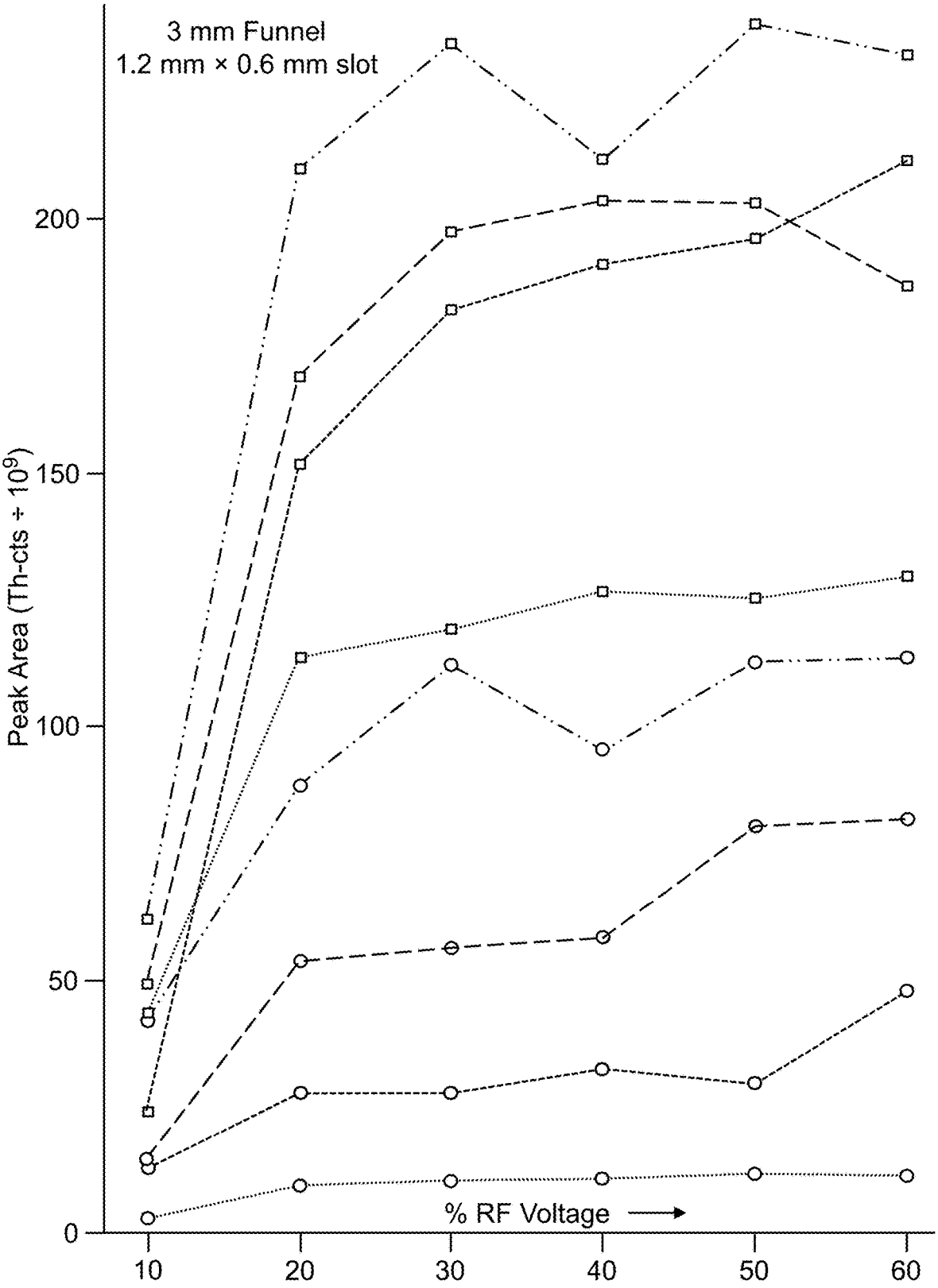
FIG. 8C is a set of graphical plots of the variation of measured abundances, with respect to applied RF voltage, of the selected tryptic HeLa peptide precursor ions referenced in FIG. 8A, as measured by a mass spectrometer equipped with a Three-Millimeter Funnel, as defined herein and in accordance with the present teachings, the ion funnel receiving ions from a 1.2 mm×0.6 mm slot of an ion transfer tube and housed within a chamber maintained at a pressure of 1.4 Torr.

Traces 59 and 69 of FIGS. 6A and 6B are further compared to results obtained using the Three-Millimeter Funnel in FIGS. 7C and 7D, respectively. In FIG. 7C, dashed-line trace 119 is a plot of the normalized mass spectral intensity of $C_{26}H_{19}O_6N_3P_3F_{40}$, as obtained using a mass spectrometer equipped with a Three-Millimeter Funnel receiving ions from a 1.2 mm×0.6 mm ion transfer tube slot and housed within a chamber maintained at a pressure of 1.7 Torr. The experimental conditions used to obtain the data of dashed-line trace 129 of FIG. 7D are similar except that the pressure within the Three-Millimeter Funnel was raised to 3.6 Torr. ultimately reducing the dependence of transmission on the RF voltage. In FIGS. 7C and 7D, the experimentally-observed intensities of each curve were re-normalized to the respective curve's plateau value in the vicinity of 250 V, thereby allowing direct comparison of the forms of the curves. These results indicate that replacing the Standard Funnel with the Three-Millimeter Funnel produces the same beneficial effects as replacing the Standard Funnel with the Fine Funnel, namely, increasing the m/z range that can be transmitted through the funnel at a single voltage and moderating the effect of changing funnel voltage on relative intensity ratios.

Another aspect of ion funnel operation that is relevant to many peptide and protein analyses is the amount by which analyte ions are fragmented during their transmission through the funnel. In order to investigate the degree of fragmentation introduced in the systems taught herein, the inventors measured fragment-to-precursor intensity ratios generated upon infusion of the tetrapeptide Met-Arg-Phe-Ala (MRFA) and upon infusion of Henrietta Lacks (HeLa) tryptic digest peptides into mass spectrometers equipped with the various funnels and slotted ion transfer tubes described herein. The MRFA peptide is a component of the Pierce™ LTQ™ Velos™ ESI Positive Ion Calibration Solution and was mass analyzed together with the other peptide calibration standard materials noted above. HeLa digest peptides were obtained from the Thermo Scientific Pierce HeLa Protein Digest Standard that is available from Thermo Fisher Scientific of Waltham, Mass. It was found that, when analyzing the HeLa peptide ions in a mass spectrometer equipped with a Standard Funnel, simple lowering of the funnel pressure from 2.6 Torr to 1.4 Torr and replacement of the 1.6×0.6 mm ion transfer tube with the 1.2×0.6 mm ion transfer tube reduced the average fragment-to-precursor ratio by a factor of 10 (data not shown). As expected, there is a respective optimal operating voltage associated with each funnel at which the precursor-to-fragment ratio is maximized. This optimal operating voltage ranges from 30% of maximum voltage, in the case of the Standard Funnel, to 60% of maximum voltage in the case of the Three-Millimeter Funnel.

While maintaining a mass spectrometer configuration using the 1.2×0.6 mm ion transfer tube and funnel pressure of 1.4 Torr, the absolute mass spectral intensities of several HeLa peptide precursor ions (m/z ratios ranging from 416.25 Th to 1067.54 Th) were measured after transmission through the Standard Funnel, the Fine Funnel and the Three-Millimeter Funnel. The measured intensities of selected precursor-ion species after transmission through the Standard Funnel, the Fine Funnel and the Three-Millimeter Funnel are plotted in FIGS. 8A, 8B and 8C, respectively, all as functions of applied relative RF voltage, K* (see U.S. Pat. No. 7,781,728). The relative RF voltage, K*, is a user-settable RF-voltage amplitude factor that is variable from 0-100. The actual applied voltage is calculated by multiplying K* together with a voltage amplitude function, f(m/z), that takes into account the known variation of fragmentation tendency as a function of m/z. The results depicted in these figures, which are all plotted on the same vertical scale, are considered to be a good representation of the relative transmission efficiencies of the three different funnel types since the fragment-ion intensities are less than 3 percent of the precursor-ion intensities under the applied experimental conditions. By considering analogous fragmentation data for approximately 50,000 identified tryptic HeLa peptides as well as selected peptides that are known for form in-source fragments, an optimal operating voltage may be determined for each funnel, where the optimal voltage is the operating voltage that, on average, transmits the greatest amount of intact precursor peptide ions across the entire m/z range. These data demonstrate ascending transmission efficiency trends using the alternative funnel designs in accordance with the present teachings.

Figure 9:
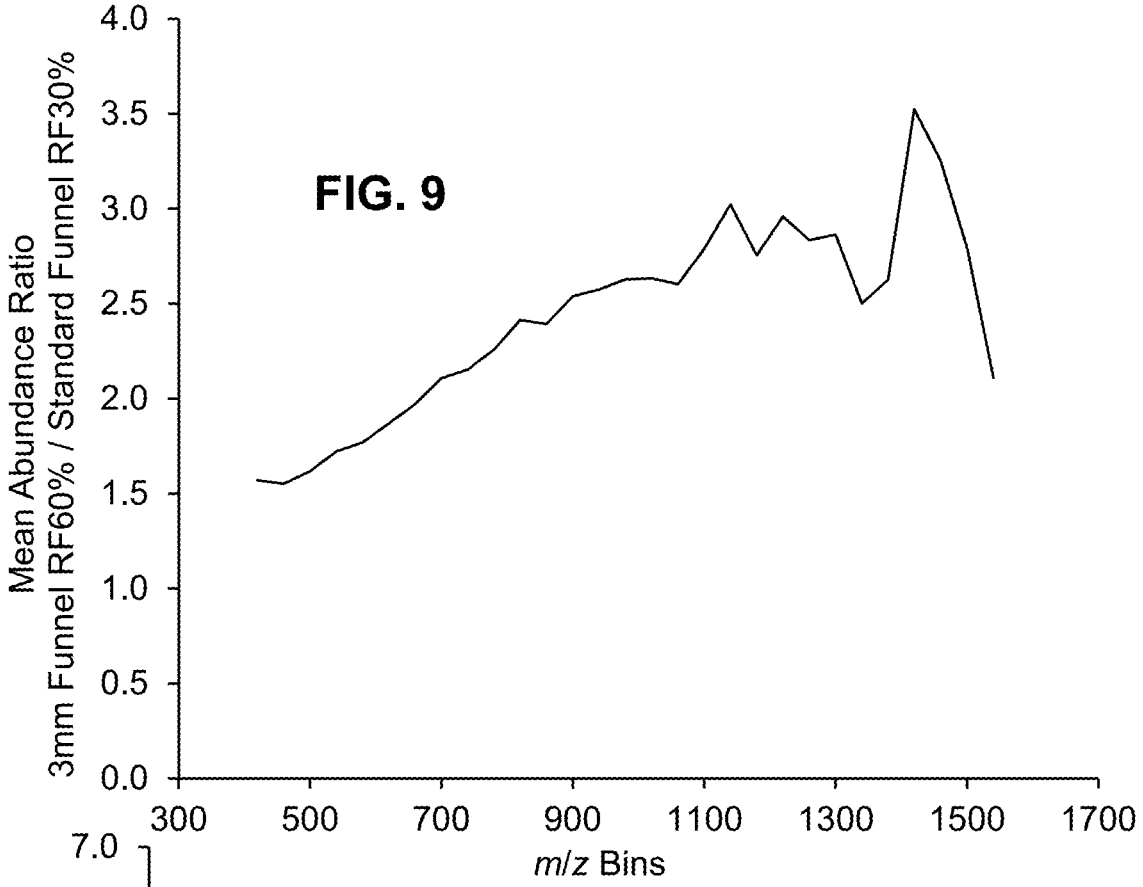
FIG. 9 is a graph of the variation of mean measured abundance ratio of all tryptic HeLa peptides, identified as a function of ink, the ratio calculated as the abundance observed using a mass spectrometer equipped with the Three-Millimeter Funnel relative to the abundance observed using a mass spectrometer equipped with the Standard Funnel, where an abundance ratio of unity indicates equivalent sensitivity.

FIG. 9 is a graph of the variation of mean measured abundance ratio of all tryptic HeLa peptides, plotted as a function of m/z, where the ratio is calculated as the abundance observed using a mass spectrometer equipped with the Three-Millimeter Funnel relative to the abundance observed using a mass spectrometer equipped with the Standard Funnel and where each funnel is operated at its respective optimal voltage. Note that an abundance ratio of unity indicates equivalent transmission efficiency. When using the optimized settings, the observed mean abundance ratio increases by a factor of between 1.5 and 3.0, relative to the Standard Funnel, depending on m/z. The m/z dependence depicted in FIG. 9 is consistent with the inverse relationship between the effects of the radially confining pseudopotential and m/z. Specifically, the Three-Millimeter Funnel allows for use of an optimal RF voltage that is greater than the optimal RF voltage of the Standard Funnel, while still producing a reduction in fragmentation. The greater optimal operating voltage of the Three-Millimeter Funnel helps to confine high mass ions, which would presumably be otherwise lost due to space charge effects near the funnel output.

Figure 10:
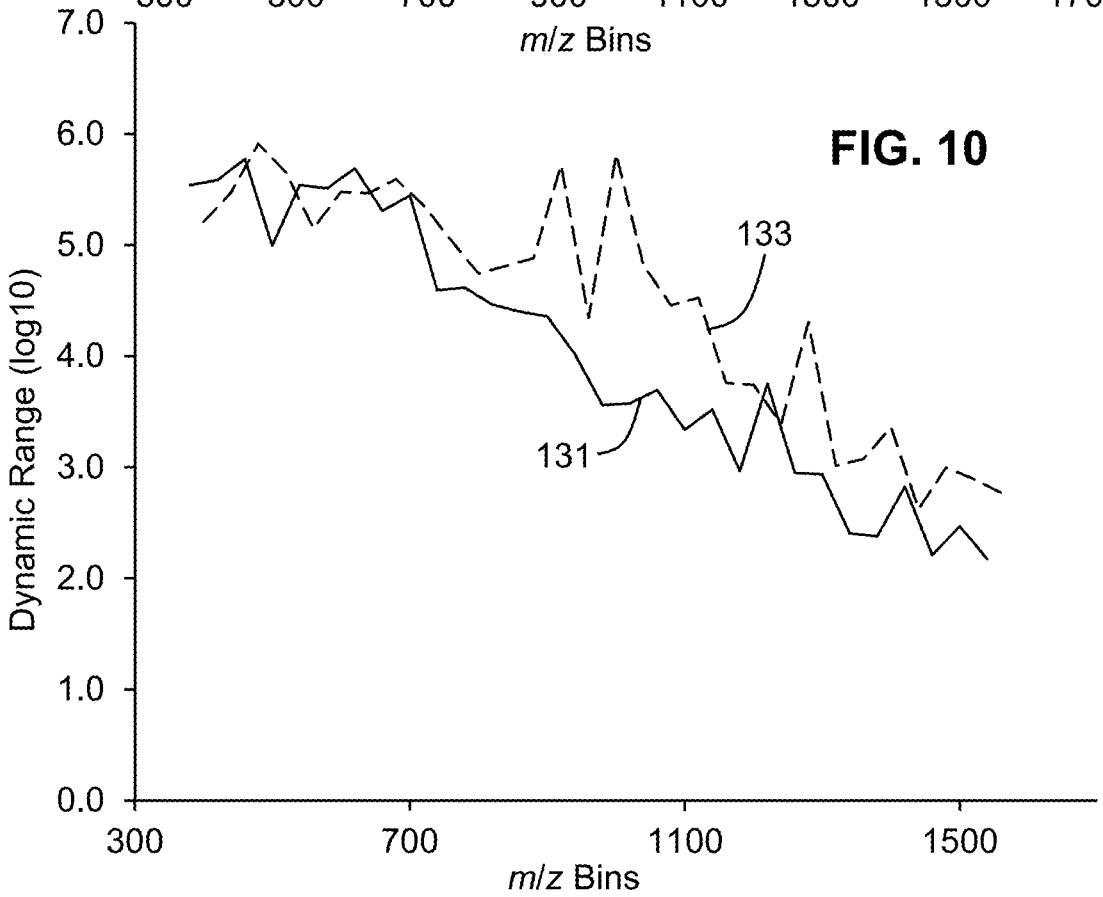
FIG. 10 is a plot of ion-abundance dynamic range, as a function of m/z, of mass spectral results obtained using a Standard Funnel and a Three-Millimeter Funnel in accordance with the present teachings.

FIG. 10 is a plot of ion-abundance dynamic range, as a function of m/z, of mass spectral results obtained using a Standard Funnel (trace 131) and a Three-Millimeter Funnel (trace 133) in accordance with the present teachings. The effect of the improvement in transmission efficiency provided by the Three-Millimeter Funnel may be taken as being equivalent to an improvement in overall sensitivity of the mass spectrometer system to low-abundance ions. This effective sensitivity improvement helps to moderate the decrease in dynamic range that would otherwise occur (i.e., trace 131) with increasing m/z when analyzing complex mixtures.

Figure 11A:
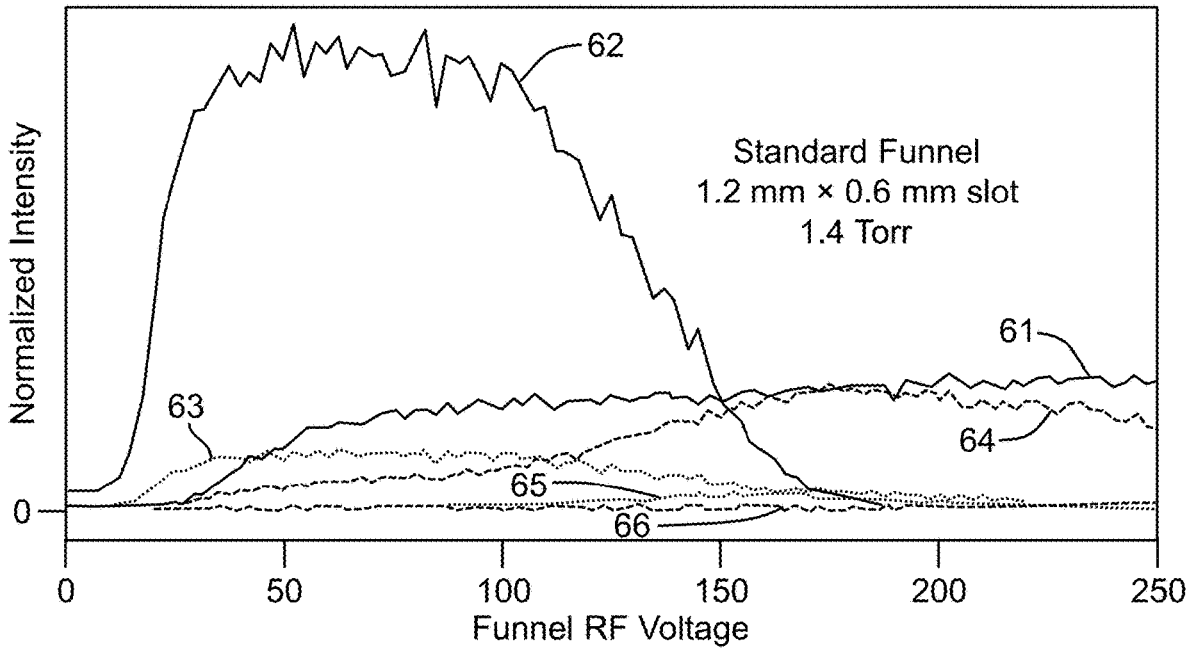
FIG. 11A is a set of graphical plots of the variation of measured mass spectral abundances, with respect to applied RF voltage, of the tetrapeptide Met-Arg-Phe-Ala (MRFA) precursor ions and of various fragment ions generated from those precursor ions within an ion funnel, as measured by a mass spectrometer equipped with a Standard Funnel, as defined herein, receiving ions from a 1.2 mm×0.6 mm slot of an ion transfer tube and housed within a chamber maintained at a pressure of 1.4 Torr.
Figure 11B:
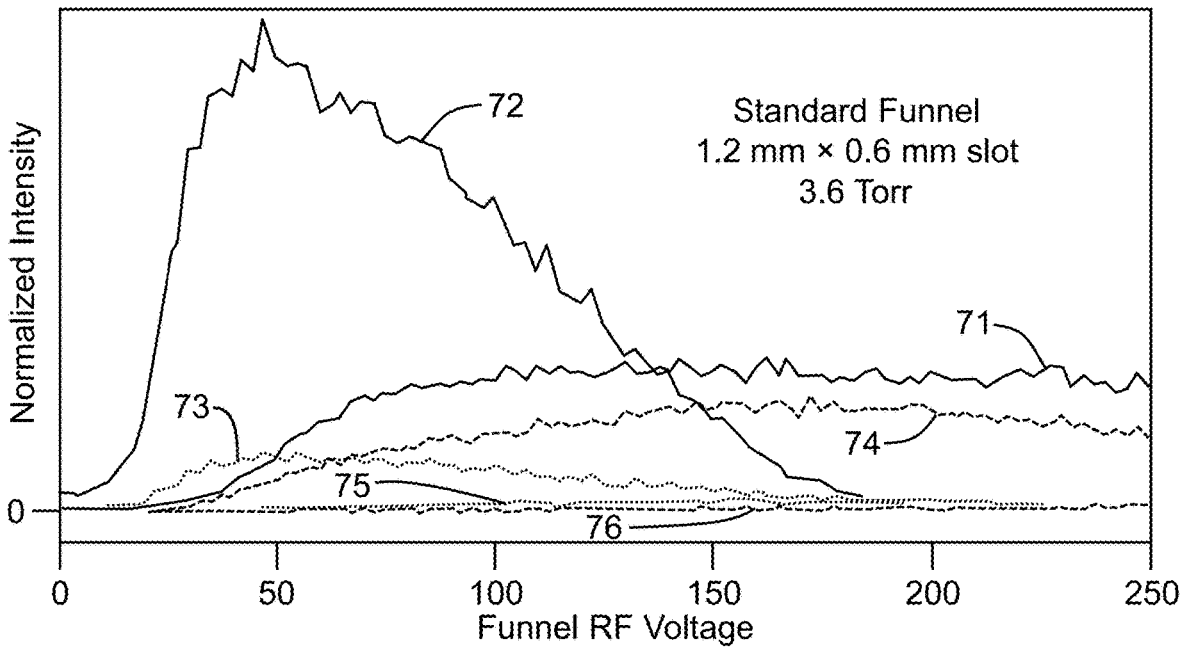
FIG. 11B is a set of graphical plots of the variation of measured abundances, with respect to applied RF voltage, of MRFA peptide precursor ions and of various fragment ions generated from those precursor ions within an ion funnel, as measured by a mass spectrometer equipped with a Standard Funnel, as defined herein, receiving ions from a 1.2 mm×0.6 mm slot of an ion transfer tube and housed within a chamber maintained at a pressure of 3.6 Torr.
Figure 11C:
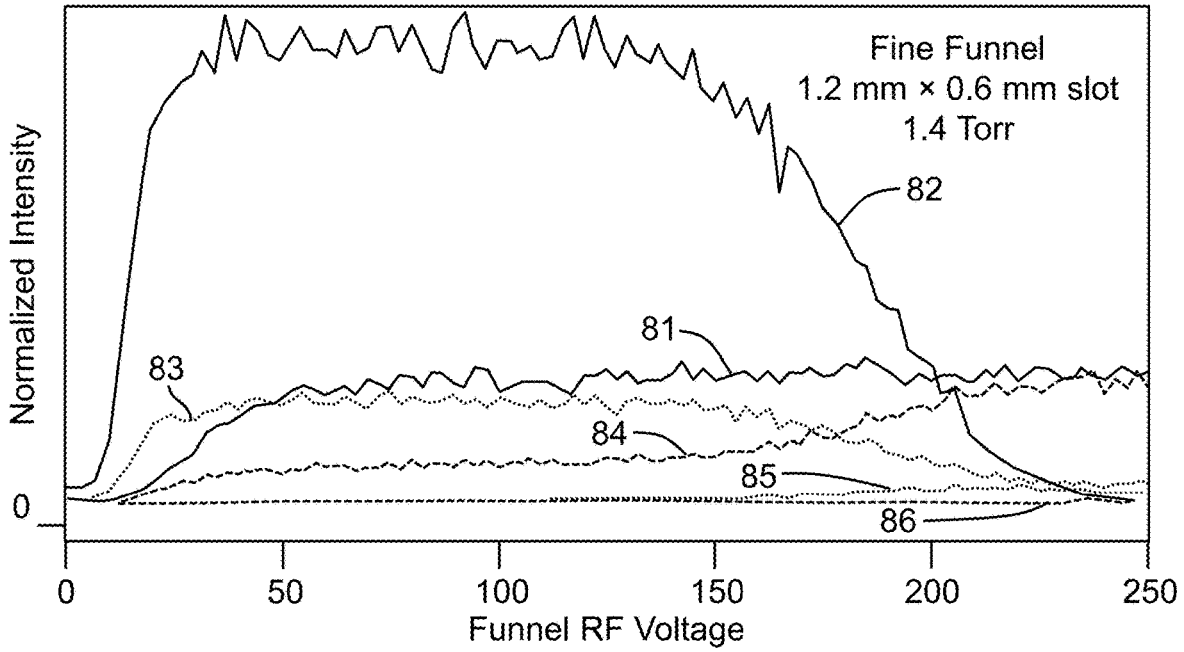
FIG. 11C is a set of graphical plots of the variation of measured abundances, with respect to applied RF voltage, of MRFA peptide precursor ions and of various fragment ions generated from those precursor ions within an ion funnel, as measured by a mass spectrometer equipped with a Fine Funnel, as defined herein and in accordance with the present teachings, the ion funnel receiving ions from a 1.2 mm×0.6 mm slot of an ion transfer tube and housed within a chamber maintained at a pressure of 1.4 Torr.
Figure 11D:
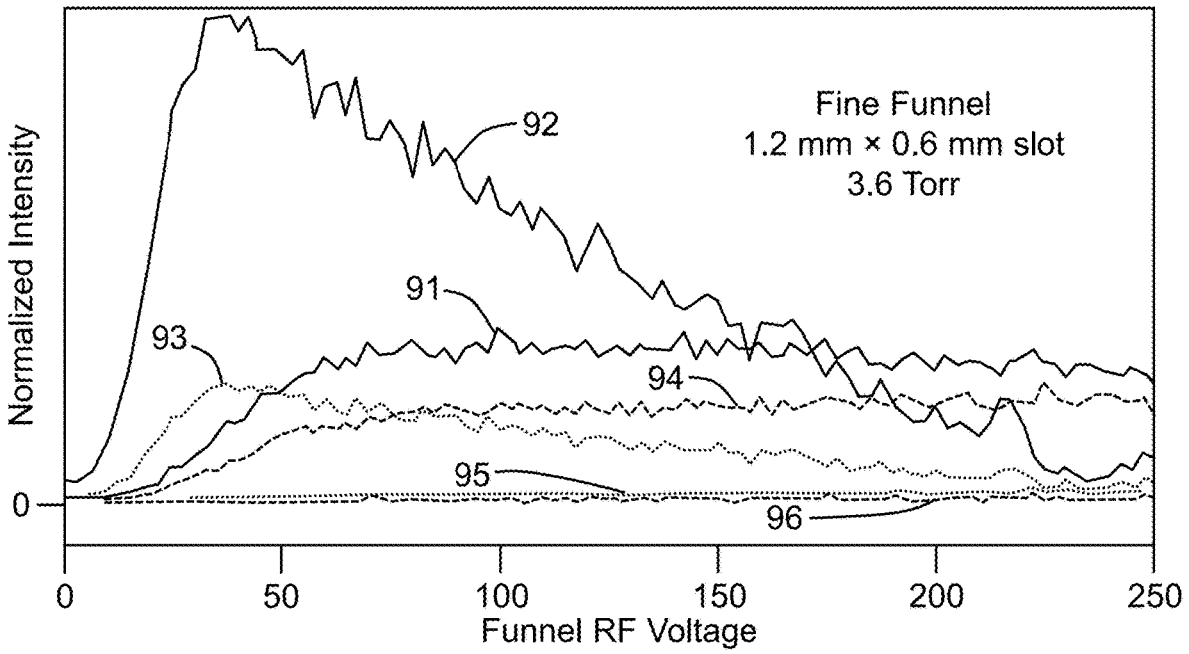
FIG. 11D is a set of graphical plots of the variation of measured abundances, with respect to applied RF voltage, of MRFA peptide precursor ions and of various fragment ions generated from those precursor ions within an ion funnel, as measured by a mass spectrometer equipped with a Fine Funnel, as defined herein and in accordance with the present teachings, the ion funnel receiving ions from a 1.2 mm×0.6 mm slot of an ion transfer tube and housed within a chamber maintained at a pressure of 3.6 Torr.
Figure 11E:
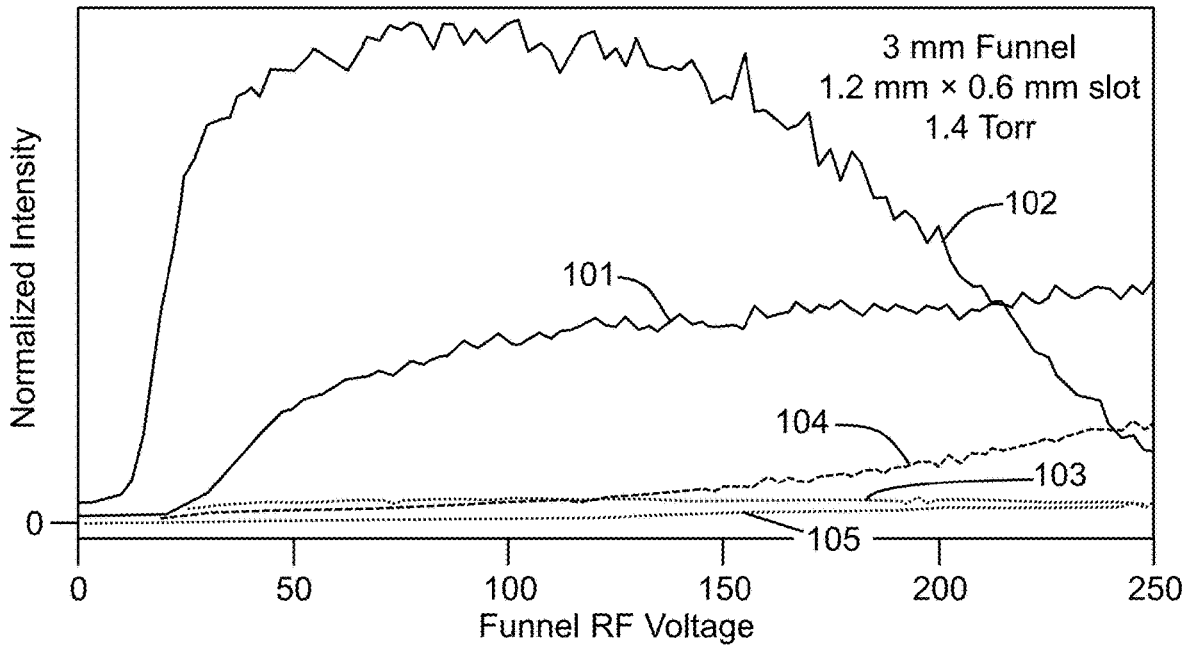
FIG. 11E is a set of graphical plots of the variation of measured abundances, with respect to applied RF voltage, of MRFA peptide precursor ions and of various fragment ions generated from those precursor ions generated within an ion funnel, as measured by a mass spectrometer equipped with a Three-Millimeter Funnel, as defined herein and in accordance with the present teachings, the ion funnel receiving ions from a 1.2 mm×0.6 mm slot of an ion transfer tube and housed within a chamber maintained at a pressure of 1.4 Torr.
Figure 11F:
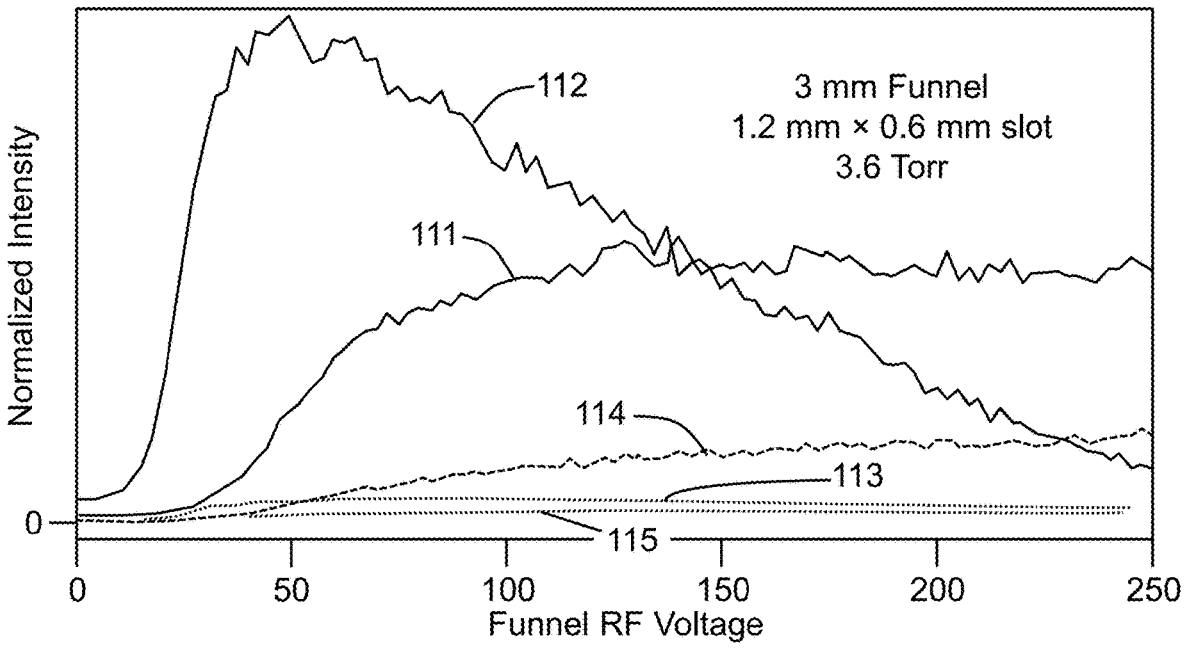
FIG. 11F is a set of graphical plots of the variation of measured abundances, with respect to applied RF voltage, of MRFA peptide precursor ions and of various fragment ions generated from those precursor ions within an ion funnel, as measured by a mass spectrometer equipped with a Three-Millimeter Funnel, as defined herein and in accordance with the present teachings, the ion funnel receiving ions from a 1.2 mm×0.6 mm slot of an ion transfer tube and housed within a chamber maintained at a pressure of 3.6 Torr.

FIGS. 11A-11F are graphical plots of the variation of measured mass spectral abundances, with respect to applied RF voltage, of MRFA peptide precursor ions and of various fragment ions generated from those precursor ions within various ion funnels. All data plotted in FIGS. 11A-11F was obtained at a funnel pressure of either 1.4 Torr or 3.6 Torr and using an ion transfer tube having a 1.2 mm×0.6 mm slot to inlet ions to the funnel. Curves FIGS. 11A-11B relate to mass spectrometer results obtained using a Standard Funnel; FIGS. 11C-11D relate to mass spectrometer results obtained using a Fine Funnel; and FIGS. 11E-11F relate to mass spectrometer results obtained using a Three-Millimeter Funnel. Curves 61, 71, 81, 91, 101 and 111 relate to the observed signals of the singly-charged MRFA precursor-ion species. Curves 62, 72, 82, 92, 102 and 112 relate to the observed signals of the doubly-charged MRFA precursor-ion species. Curves 63, 73, 83, 93, 103 and 113 relate to the observed signals of the ion species resulting from loss of an $NH_3$ group from the b2 fragment ion. Curves 64, 74, 84, 94, 104 and 114 relate to the observed signals of the y3 fragment-ion species. Curves 65, 75, 85, 95, 105 and 115 relate to the observed signals of the b2 fragment-ion species. Finally, curves 66, 76, 86, 96, 106 and 116 relate to the observed signals of the ion species resulting from loss of an $NH_3$ group from the y3 fragment-ion. Comparisons between the plotted data of FIGS. 11A-11B and either the plotted data of FIGS. 11C-11D or FIGS. 11E-11F generally demonstrate: (a) a reduction of within-funnel fragmentation by reducing the pressure and reducing the length of the slot of the slotted ion transfer tube capillary; (b) a reduction of within-funnel fragmentation by replacement of the Standard Funnel with either the Fine Funnel or the Three-Millimeter Funnel; and an improvement in the transmission of intact singly and doubly charged MRFA precursor ions across a wide•RF voltage range and with less fragmentation at high RF voltage by replacement of the Standard Funnel with either the Fine Funnel or the Three-Millimeter Funnel.

Figure 12:
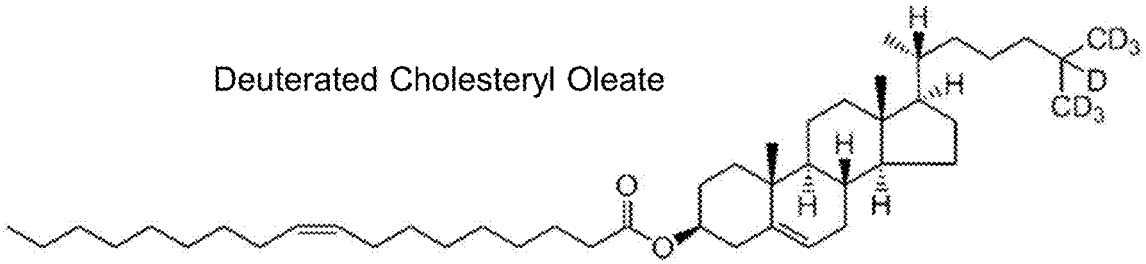
FIG. 12 is a depiction of the molecular structure of a compound, deuterated cholesteryl oleate, whose fragmentation behavior has been studied during transport of the said compound within ion funnel apparatuses of the present teachings.

As discussed in detail above, the reduction of penetration of RF fields into the interior of ion transport apparatuses in accordance with the present teachings (e.g., see FIGS. 5B-5D) provides a beneficial effect, relative to conventional ion funnels, of reducing fragmentation of ions within the ion funnel interior. Nonetheless, the inventors have found that, even with the beneficial effect of reduced RF field penetration, certain very fragile ions may nonetheless undergo significant fragmentation when transported through ion transport apparatuses comprising an ion funnel portion and/or ion tunnel portions as described herein. For example, FIG. 12 shows the molecular structure of one such fragile ion, deuterated cholesteryl oleate. Substituted R-Benzylpyridium ions are another class of ions that have been found to be particularly susceptible to fragmentation in ion funnels. This latter class of ions includes, in increasing order of fragility, nitro-benzylpyridinium, cyano-benzylpyridinium, chloro-benzylpyridinium, methyl-benzylpyridinium and methoxy-benzylpyridinium.

It has been noted that the degree of penetration of RF fields into the interior of an ion transport apparatus of the type described herein generally increases in a direction towards the outlet of the apparatus (FIGS. 5A-5D). Based on this observation but without being bound to or constrained by any particular theory or hypothesis, the inventors have reasoned that, by providing an additional axial DC electric field in a region that is near to the outlet and that accelerates ions towards and through the exit electrode 12, the duration of time that ions occupy the region of high RF-field penetration may be shortened, thereby causing a reduction in overall undesired fragmentation. In this case the fragmentation that is observed in the absence of the applied additional axial DC electric field is believed to be caused by RF heating of the ions. Additionally, the inventors have reasoned that, by providing the additional axial DC electric field such that the ions' movement towards the funnel outlet is retarded, the removal of certain loosely-bound unwanted adduct moieties (for example, water, hydroxyl, alkali ions, etc.) may be facilitated by longer-duration exposure to the RF heating. The axial field that is required to either accelerate or retard ions movement towards the ion outlet in this fashion is generated by applying an electrical potential difference, ΔV, between an exit electrode and adjacent electrode. Further, by providing an even greater-magnitude electrical potential difference, depending on the spacing between the exit electrode and the adjacent electrode, a stronger electric field may be generated that causes in-source fragmentation of source-derived ions ("precursor" ions) through a collision-induced dissociation mechanism that is similar to fragmentation mechanisms that are operative in dedicated fragmentation cells. In this latter case, the sign of the voltage difference is, ΔV, is chosen so as to strongly accelerate the precursor ions towards the exit electrode, thereby causing energetic collisions of the precursor ions with background gas molecules.

As a non-limiting example (FIGS. 15 and 16), an accelerating DC potential $0<\Delta V\leq 10$ volts, depending on electrode spacing and gas pressure, may be employed to reduce ion fragmentation within an ion funnel/tunnel apparatus. As an additional non-limiting example, an accelerating DC potential of greater than or equal to 50 volts up and up to the Paschen breakdown limit, depending on electrode spacing, gas pressure, and molecular bond strength, may be employed to conduct in-source collision-induced dissociation of ions. Because the fragmentation is dependent on electrode spacing and pressure (or rather gas number density, N), the behavior of ion transport apparatuses in accordance with the present teachings may be alternatively characterized in terms of E/N, where E is the DC electric field strength, instead of in terms of applied voltage difference, ΔV. These parameters will vary depending upon specific electrode spacing and geometry of any particular funnel apparatus. Therefore, any particular apparatus may require appropriate optimization and tuning.

Figure 13:
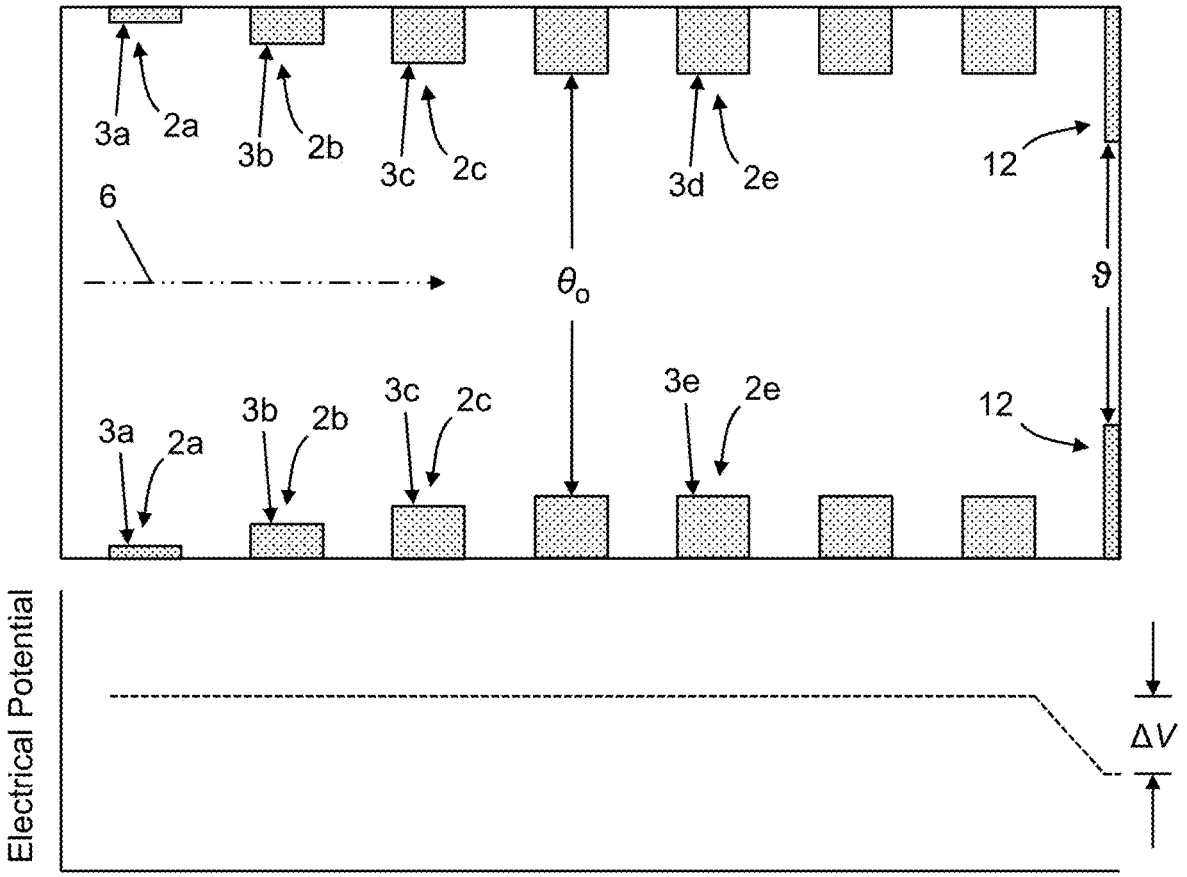
FIG. 13 is a schematic depiction of application of an electrical potential difference between an exit electrode and an adjacent ring or plate electrode of the downstream "ion tunnel" portion of the ion funnel apparatus of FIG. 2C.

FIG. 13 is a schematic depiction of application of a DC electrical potential difference, ΔV, between an exit electrode 12 and the furthest-downstream plate electrode 2*a*-2*e* of the downstream "ion tunnel" portion of the 3 mm ion transport apparatus of FIG. 2C. Note that, whereas RF voltage waveforms are applied to the plate electrodes, the exit electrode 12 generally does not receive an RF voltage. Note, also, that the exit electrode 12 may comprise an exit lens and may also be referred to as such. Positively-charged ions that are transported through the apparatus parallel to the central longitudinal axis 6 in FIG. 13 in the direction of arrow will be accelerated towards the exit electrode 12 by the electric field that is implied by the illustrated negative sign of ΔV. Similarly, negatively-charged ions may be accelerated towards the exit electrode 12 by reversal of the sign of ΔV. Such an accelerating potential may be expected to reduce ion fragmentation, not only within the 3 mm ion transport apparatus of FIG. 2C but, more generally, within any ion funnel or ion tunnel apparatus.

Figure 14A:
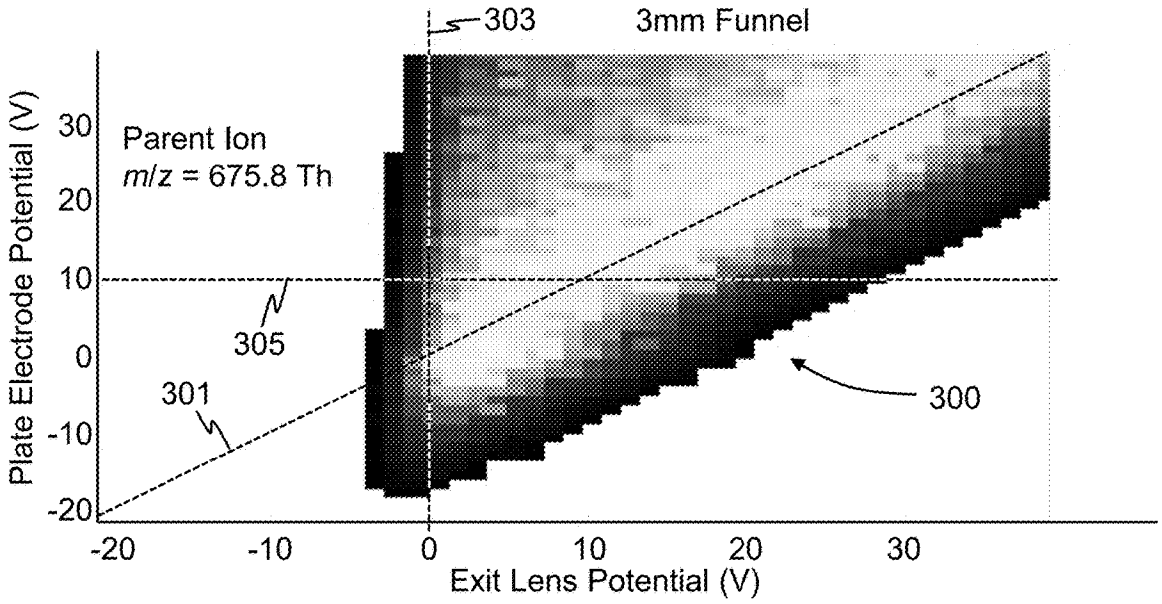
FIG. 14A is a shaded contour plot of the measured intensity of unfragmented deuterated cholesteryl oleate ions transmitted through the ion funnel apparatus of FIG. 2C, the measured intensity plotted as a function of the electrical potential applied to the exit lens of the apparatus and the electrical potential applied to the ring or plate electrodes of the apparatus.
Figure 14B:
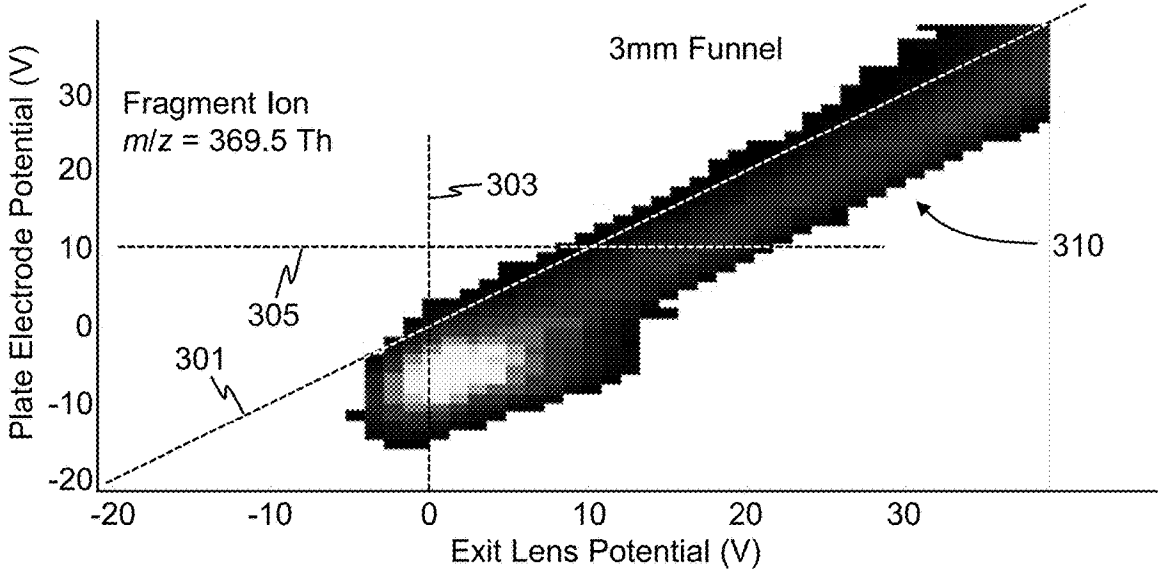
FIG. 14B is a shaded contour plot of the measured intensity of fragment ions generated by fragmentation of deuterated cholesteryl oleate ions during their transport through the ion funnel apparatus of FIG. 2C, the measured intensity plotted as a function of the electrical potential applied to the exit lens of the apparatus and the electrical potential applied to the ring or plate electrodes of the apparatus.

To determine the effects of providing an additional axial electric field at the outlet ends of ion transport apparatuses comprising ion funnel and/or ion tunnel portions, measurements have been made of the signal intensities of fragile ions and their fragmentation products upon transmission through the apparatus of FIG. 3C with various voltages applied to exit electrode 12 and to the funnel/tunnel plate electrodes. For example, FIG. 14A is a shaded contour plot, shown generally at region 300, of the measured intensity of electrospray-generated, positively-charged, unfragmented deuterated cholesteryl oleate ions (m/z=675.8 Th) transmitted through the ion transport apparatus of FIG. 2C. FIG. 14B is a shaded contour plot, shown generally at region 310, of the measured intensity of fragment ions (m/z=369.5 Th) generated from deuterated cholesteryl oleate, as transmitted through the same ion transport apparatus. In each shaded contour plots of FIG. 14A-14B, darker shading represents fewer transmitted ions and brighter shading represents greater numbers of transmitted ions, except that the white background outside of the indicated regions 300, 310 represents negligible ion transmission.

Conventional ion funnel/tunnel ion transport apparatuses are generally operated in one of two ways: (1) with a voltage divider between all lens elements (first funnel/tunnel electrode to last funnel/tunnel electrode) that creates a DC gradient across the length of the apparatus or (2) without a DC gradient whereby all funnel/tunnel electrodes are maintained at a common DC offset potential. (This DC offset potential being in addition to the supplied RF voltage waveforms for which the RF waveform applied to each electrode is $\pi/2$ radians out of phase with the RF waveforms supplied to immediately adjacent electrodes.) Diagonal line 301, having a slope of unity, represents the locus of pairs of voltages applied to the plate electrodes and to the exit electrode under the second such mode of conventional operation. However, in accordance with the present teachings, methods of transferring ions in a mass spectrometer include the application of an electrical potential difference, ΔV, between an exit electrode 12 and the furthest-downstream plate electrode 2*a*-2*e* of an ion funnel or ion tunnel apparatus. Thus, ion funnel/tunnel ion transport apparatuses in accordance with the present teachings differ from conventional apparatuses in that, whereas there is no gradient along the majority of the length of the apparatus, there does exist a localized axial DC gradient at the funnel output, which is believed to comprise a region where most or all fragmentation occurs. Accordingly, the results shown in FIGS. 14A, 14B, 15 and 16 were obtained using an ion transport apparatus that was configured such it was possible to apply a first variable voltage to the tunnel/funnel plate electrodes and independently apply a second variable voltage to the exit electrode.

The results shown in FIG. 14A indicate that the yield of unfragmented parent ions generally improves when the voltage applied to the ion tunnel/funnel plate electrodes is slightly more positive than the voltage applied to the exit electrode (i.e, in a portion of the region 300 that is slightly above line 301). This corresponds to a local axial electric field that accelerates the positively-charged parent ions towards the exit electrode and out of the ion transport apparatus. The results shown in FIG. 14B appear to confirm that a reduction in the degree of fragment generation is the cause of this increased parent-ion yield.

Figure 15:
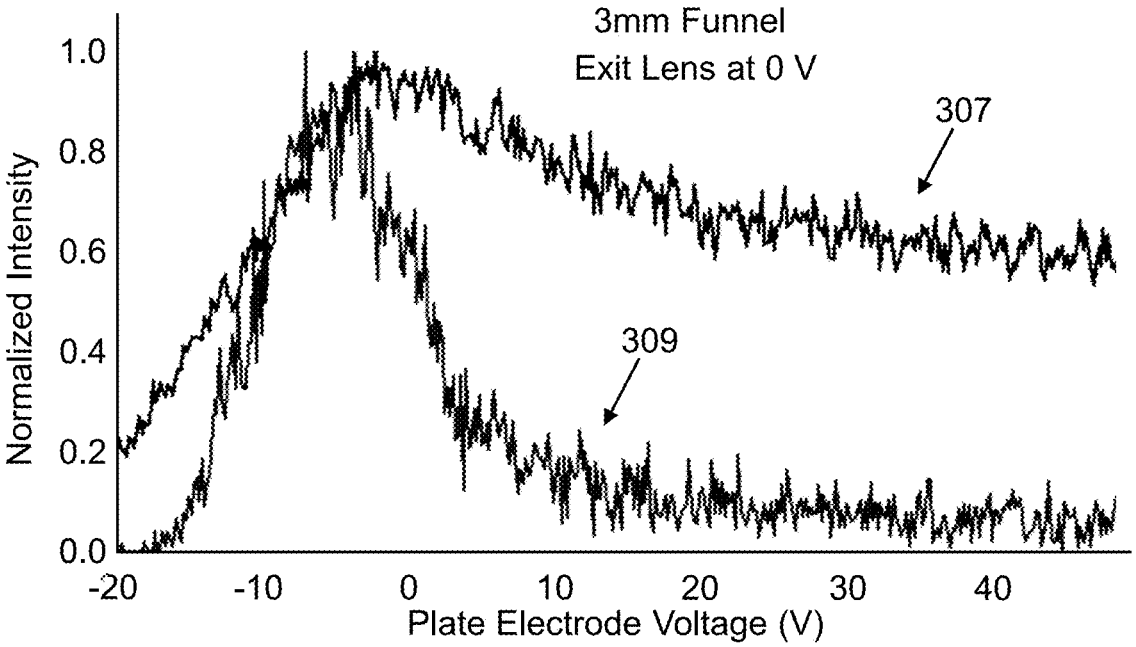
FIG. 15 is a plot of the normalized intensity of unfragmented deuterated cholesteryl oleate ions during their transport through the ion funnel apparatus of FIG. 2C and a separately normalized plot of the measured intensity of fragment ions generated by fragmentation of the deuterated cholesteryl oleate ions during the transport of those ions through the ion funnel apparatus, the measured intensities plotted as a function the ring or plate electrode voltage with the exit lens maintained constant at ground potential.
Figure 16:
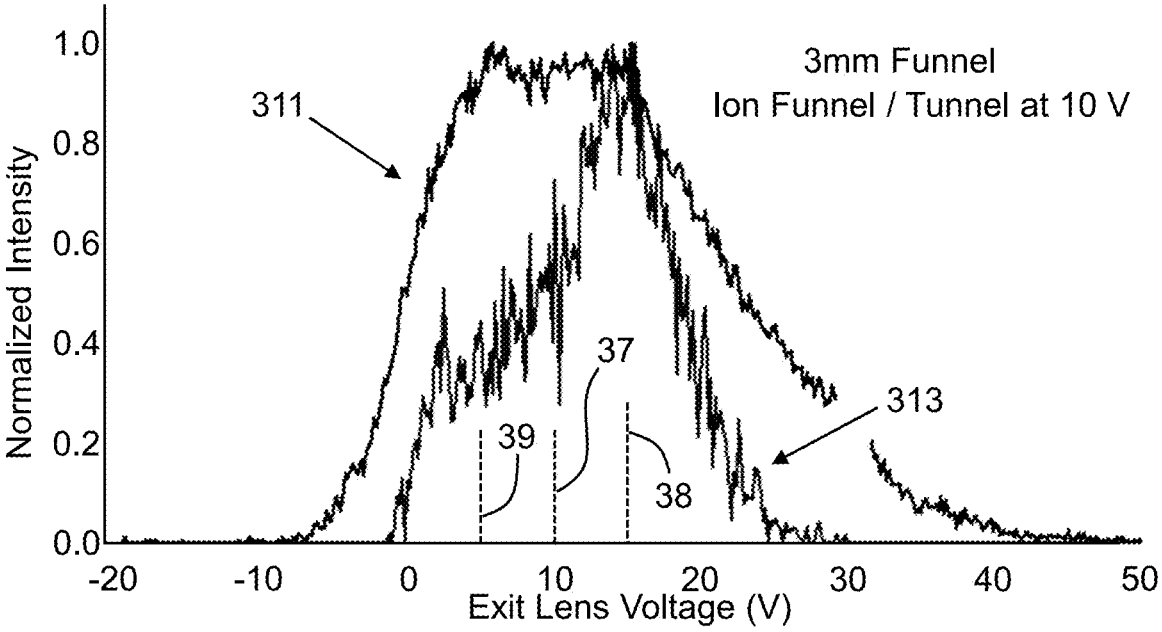
FIG. 16 is a plot of the normalized intensity of unfragmented deuterated cholesteryl oleate ions during their transport through the ion funnel apparatus of FIG. 2C and a separately normalized plot of the measured intensity of fragment ions generated by fragmentation of the deuterated cholesteryl oleate ions during the transport of those ions through the ion funnel apparatus, the measured intensities plotted as a function the exit lens voltage with the ring or plate electrodes maintained constant at 10 Volts.

FIGS. 15 and 16, which further illustrate these effects, are selected cross sections through the three-dimensional data that is depicted as shaded contour plots in FIGS. 14A-14B. Specifically, FIG. 15 is a plot of the normalized intensity of unfragmented deuterated cholesteryl oleate ions (plot 307) and of the separately-normalized intensity of fragment ions (plot 309) at various plate electrode potentials when the exit lens potential is constant at zero volts (i.e., taken along the line 303 of FIGS. 14A-14B). Similarly, FIG. 16 is a plot of the normalized intensity of the unfragmented ions (plot 311) and of the separately-normalized fragment ions (plot 313) at various exit electrode potentials when the plate electrode potential is constant at +10 volts (i.e., taken along the line 305 of FIGS. 14A-14B).

FIG. 15 clearly shows that the abundance of fragment ions, as shown by plot 309, is at a maximum when the electrical potential of the plate electrodes of the ion transport apparatus is approximately 6 V more negative than the electrical potential of the exit electrode. However, the abundance of fragment ions rapidly decreases at the electrical potential of the plate electrodes is increased above the potential that corresponds to the fragment-ion maximum. When the plate electrode voltage is at the same potential as the exit electrode, corresponding to conventional ion funnel operation and an abscissa value of zero in FIG. 15, the abundance of fragment ions has decreased from its maximum by about 30 percent. It is found that, as the electrical potential of the plate electrodes is further increased, thereby creating a local axial field that accelerates positively charged ions towards the exit electrode, the abundance of fragment ions becomes negligible. In contrast, the abundance of parent ions (plot 307) exhibits a broad maximum at an abscissa value of approximately 0 V and decreases only slightly as the plate electrode voltage is increased further. Thus, in this case, application of a plate electrode voltage that is more positive than the voltage of the exit electrode significantly improves the ratio of parent ions to fragment ions.

In FIG. 16, the vertical line 37 corresponds to conventional operation in which identical voltages (in this case, 10 V) are applied to the plate electrodes of the ion transport apparatus and to the exit lens. It is observed that, by decreasing the potential of the exit lens by 5 V relative to conventional operation (the decreased potential corresponding to vertical line 39), the abundance of fragment ions (plot 313) leaving the ion transport apparatus is reduced by about thirty percent, relative to conventional operation, while the abundance of parent ions (plot 311) is essentially unaffected. Further, by increasing the exit lens voltage by 5 V relative to conventional operation (the increased potential corresponding to vertical line 39), the abundance of fragment ions significantly increases by about forty percent, relative to conventional operation. Accordingly, given a particular degree of analyte fragility and using the particular apparatus to which the data of FIGS. 14A, 14B, 15 and 16 pertains, an analyst could choose a set of applied plate electrode and exit lens voltages that produces a maximum parent ion to fragment ion ratio.

A qualitative or quantitative "degree of fragility" of various ion species or classes of ion species may be developed by transporting the various ion species or ion species classes to a mass analyzer through a standardized configuration of an ion transport apparatus that is operated under standardized experimental conditions, such as standardized conditions of gas pressure, RF amplitude, etc. A ratio of detected fragment ions to detected parent ions, as measured by the mass analyzer while operating the ion transport apparatus under the standardized experimental conditions, may then be used as the quantitative fragility scale or may be used to develop the qualitative fragility scale.

Figure 17:
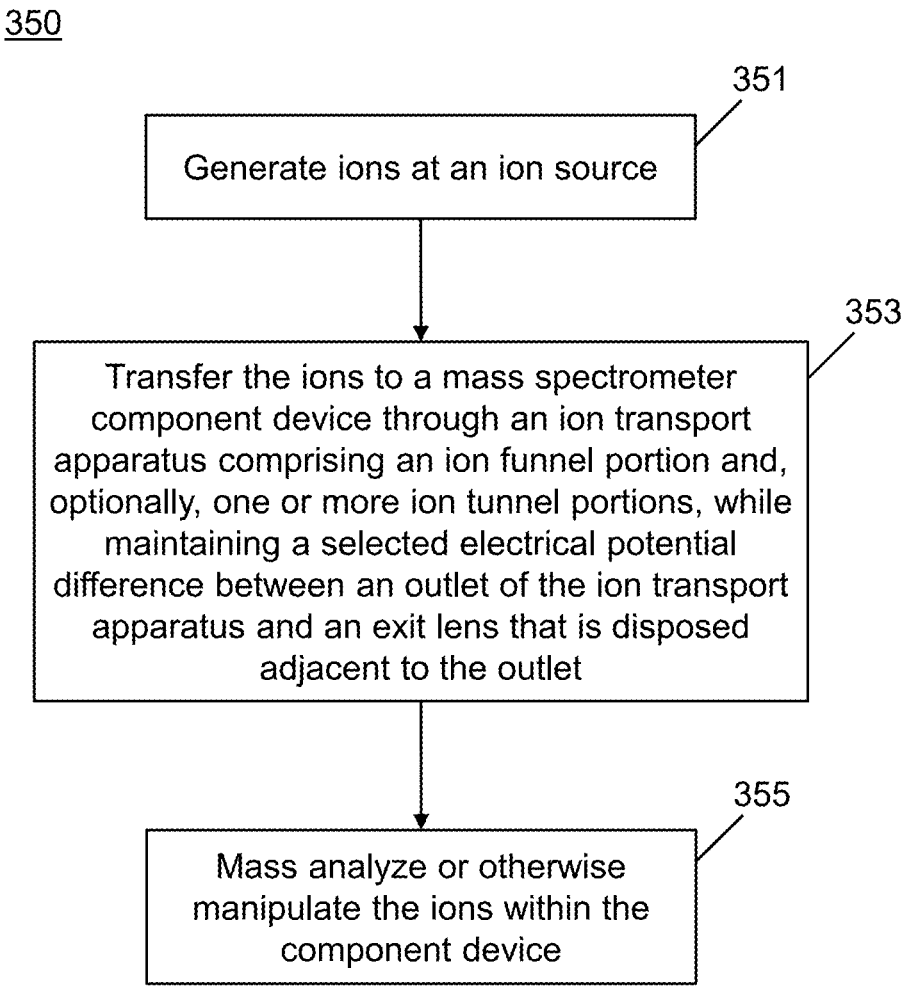
FIG. 17 is a flow diagram of a method for transferring ions from an ion source to a mass analyzer of a mass spectrometer.

FIG. 17 is a flow diagram of a method 350 for transferring ions from an ion source to a downstream component of a mass spectrometer. The mass spectrometer apparatus will generally include an ion transport apparatus disposed between the ion source and the downstream component, the ion transport apparatus comprising at least an ion funnel portion, the ion funnel portion comprising a plurality of stacked plate or ring electrodes to which ion-confining RF voltage waveforms are applied, with the RF phase applied to each plate or ring electrode being $\pi$ radians out of phase with each other adjacent plate or ring electrode. The ion transport apparatus may also comprise one or more ion tunnel portions. The "downstream component" may be a mass analyzer of the mass spectrometer that generates a mass analysis of the received ions. Alternatively, the downstream component may be some other component, such as an ion lens, an ion guide, a mass filter, an ion fragmentation cell, etc. that manipulates ions received from the ion transport apparatus in some fashion, such as by guiding the ions, filtering the ions, subjection the ions to ion/molecule collisions, causing an ion/ion reaction, etc., prior to mass analysis by a mass analyzer.

In step 351 of the method 350, ions are generated by the ion source. The ions from the ion source are then transmitted to the mass spectrometer component through the ion transport apparatus in step 353. During this transport operation, a selected electrical potential difference is applied between the nearest electrode of the ion transport apparatus and an exit lens disposed at the apparatus outlet. The sign of the electrical potential difference—either positive or negative—is determined based on an analysts desire to either: (1) limit unwanted fragmentation of ion species of an analyte or else (2) increase fragmentation that removes certain adduct moieties from the ion species. The magnitude of the applied electrical potential difference (or axial field strength) may be based on a known qualitative or quantitative degree of fragility of certain ion species of interest as determined by a previous calibration of the percentage of ion fragmentation of such species versus the electrical potential difference (or axial field strength, as may be derived from the electrical potential difference and the physical separation distance between the exit lens and the transport apparatus electrode). The calibration may make use of data such as is illustrated in FIGS. 14A, 14B, 15 and 16 to determine a desired electrical potential difference or desired axial electric field strength. Finally, in step 355, the ions are either mass analyzed or otherwise manipulated (such as by mass filtering, fragmentation, ion-ion reaction, etc.) by the mass spectrometer component to which the ions were transported in the previous step.

Improved ion funnel apparatuses and improved methods for transferring ions from an ion source to a mass analyzer through ion funnels have been herein disclosed. The general advantages of ion funnels in accordance with the present teachings and the use of such funnels to transmit ions are: (a) improved transmission of low mass (i.e., m/z<~100 Th) ions; (b) broader operational voltage range; (c) improved ability to transmit ions having a wide mass range of m/z values using a single RF voltage; (d) increased charge capacity; (e) reduced fragmentation and superior resistance to fragmentation at high RF voltages; (f) improved mass spectrometer sensitivity, especially for high m/z peptides in complex mixtures; and (g) reduced variation of instrumental dynamic range m/z dependence on when analyzing complex mixtures.

The discussion included in this application is intended to serve as a basic description. The present invention is not intended to be limited in scope by the specific embodiments described herein, which are intended as single illustrations of individual aspects of the invention. Functionally equivalent methods and components are within the scope of the invention. Various other modifications of the invention, in addition to those shown and described herein will become apparent to those skilled in the art from the foregoing description and accompanying drawings. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. An ion transport apparatus comprising:

an ion tunnel comprising a first plurality of plate electrodes configured as a stack, each electrode of the first plurality of electrodes having an aperture therein, all apertures of the first plurality of electrodes having a same diameter, $\theta_{T1}$, wherein each electrode of the first plurality of electrodes is separated from each adjacent preceding or adjacent succeeding electrode of the first plurality of electrodes by an inter-electrode pitch, $d_1$; and an ion funnel comprising:

a first ion funnel portion comprising:

an ion inlet end that is disposed adjacent to the ion tunnel section;

an ion outlet end; and a second plurality of plate electrodes configured as a stack, each electrode of the second plurality of electrodes comprising an aperture therein, each aperture having a respective diameter, $\theta_{F1}$, where $\theta_1 \leq \theta_{F1} < \theta_{T1}$, wherein each electrode of the second plurality of electrodes is separated from each adjacent preceding or adjacent succeeding electrode of the second plurality of electrodes by the inter-electrode pitch, $d_1$; and a second ion funnel portion comprising:

an outlet end;

an inlet end that is disposed adjacent to the outlet end of the first ion funnel portion; and a third plurality of plate electrodes configured as a stack, each electrode of the third plurality of electrodes comprising an aperture therein, each aperture having a respective diameter, $\theta_{F2}$, where $\theta_2 \leq \theta_{F2} < \theta_1$, wherein each electrode of the third plurality of electrodes is separated from each adjacent preceding or adjacent succeeding electrode of the third plurality of electrodes by a second inter-electrode pitch, $d_2$, wherein $d_2 < d_1$.

2. An ion transport apparatus as recited in claim 1, wherein the aperture diameter, $\theta_{F2}$, of each of the third plurality of plate electrodes is greater than or equal to three times the second inter-electrode pitch, $d_2$.

3. An ion transport apparatus as recited in claim 1, wherein $d_2 \leq (d_1/2)$.

4. An ion transport apparatus as recited in claim 1, further comprising:

a second ion tunnel section comprising:

an outlet end;

an inlet end that is disposed adjacent to the outlet end of the second ion funnel portion; and a fourth plurality of plate electrodes configured as a stack, each electrode of the fourth plurality of electrodes having an aperture therein, all apertures of the fourth plurality of electrodes having a same diameter, $\theta_{T2}$, where $\theta_{T2} \leq \theta_2$, wherein each electrode of the fourth plurality of electrodes is separated from each adjacent preceding or adjacent succeeding electrode of the fourth plurality of electrodes by the second inter-electrode pitch, $d_2$.

5. An ion transport apparatus as recited in claim 1, wherein $d_2 \leq (d_1/2)$.

6. An atmosphere-to-vacuum ion transport system comprising:

an ion transfer tube extending between an atmospheric-pressure ionization chamber and a partially evacuated chamber;

an ion tunnel comprising a first plurality of plate electrodes configured as a stack, each electrode of the first plurality of electrodes having an aperture therein, all apertures of the first plurality of electrodes having a same diameter, $\theta_{T1}$, wherein each electrode of the first plurality of electrodes is separated from each adjacent preceding or adjacent succeeding electrode of the first plurality of electrodes by an inter-electrode pitch, $d_1$;

an ion funnel comprising:

a first ion funnel portion comprising:

an ion inlet end that is disposed adjacent to the ion tunnel section;

an ion outlet end; and a second plurality of plate electrodes configured as a stack, each electrode of the second plurality of electrodes comprising an aperture therein, each aperture having a respective diameter, $\theta_{F1}$, where $\theta_1 \leq \theta_{F1} < \theta_{T1}$, wherein each electrode of the second plurality of electrodes is separated from each adjacent preceding or adjacent succeeding electrode of the second plurality of electrodes by the inter-electrode pitch, $d_1$; and a second ion funnel portion comprising:

an outlet end;

an inlet end that is disposed adjacent to the outlet end of the first ion funnel portion; and a third plurality of plate electrodes configured as a stack, each electrode of the third plurality of electrodes comprising an aperture therein, each aperture having a respective diameter, $\theta_{F2}$, where $\theta_2 \leq \theta_{F2} < \theta_1$, wherein each electrode of the third plurality of electrodes is separated from each adjacent preceding or adjacent succeeding electrode of the third plurality of electrodes by a second inter-electrode pitch, $d_2$, wherein $d_2 < d_1$; and an exit electrode configured to receive the charged particles from the ion funnel and to deliver the charged particles to a high-vacuum chamber, wherein no DC electrical potential gradient is applied between the exit electrode and an adjacent one of the first plurality of plate electrodes.

7. An atmosphere-to-vacuum ion transport system as recited in claim 6, wherein the aperture diameter, $\theta_{F2}$, of each of the third plurality of plate electrodes is greater than or equal to three times the second inter-electrode pitch, $d_2$.

8. An atmosphere-to-vacuum ion transport system as recited in claim 6, wherein the exit electrode has an exit aperture therein having a diameter, $\vartheta$, wherein $\vartheta \leq 2$ millimeters.

9. An atmosphere-to-vacuum ion transport system as recited in claim 6, wherein a longitudinal axis of the ion transfer tube is disposed at a non-zero angle, $\beta$, relative to a central longitudinal axis of the ion funnel.

10. An atmosphere-to-vacuum ion transport system as recited in claim 9, wherein $\beta \leq 2$ degrees.

11. An atmosphere-to-vacuum ion transport system as recited in claim 9, wherein the ion transfer tube comprises a slotted bore.

12. An atmosphere-to-vacuum ion transport system as recited in claim 6, further comprising:

a second ion tunnel disposed between the second ion funnel portion and the exit electrode comprising:

an outlet end;

an inlet end that is disposed adjacent to the outlet end of the second ion funnel portion; and a fourth plurality of plate electrodes configured as a stack, each electrode of the fourth plurality of electrodes having an aperture therein, all apertures of the fourth plurality of electrodes having a same diameter, $\theta_{T2}$, where $\theta_{T2} \leq \theta_2$, wherein each electrode of the fourth plurality of electrodes is separated from each adjacent preceding or adjacent succeeding electrode of the fourth plurality of electrodes by the second inter-electrode pitch, $d_2$.

13. A method for determining an optimal operating amplitude of a Radio Frequency (RF) voltage that is applied to an ion-funnel apparatus that is configured to transfer peptide, polypeptide or protein ions from an ion source to a mass analyzer of a mass spectrometer, the method comprising:

introducing known quantities of one or more standard peptide, polypeptide or protein compounds into the ion source and generating ions therefrom;

passing the ions from the ion source to the mass analyzer while causing the RF voltage amplitude that is applied to the ion funnel apparatus to vary among a plurality of RF amplitude values and while otherwise operating the mass spectrometer under non-varying conditions;

for each applied RF voltage amplitude, measuring a signal representative of a quantity of intact peptide, polypeptide or protein ions that are detected by the mass analyzer while applying the respective each RF voltage amplitude to the ion funnel apparatus;

determining, for each applied RF voltage amplitude, a respective value of an ion-fragmentation metric that is based, at least in part, on the plurality of measured signals and that relates to a degree of fragmentation of the peptide, polypeptide or protein ions within the ion funnel apparatus; and setting the optimal operating amplitude of the RF voltage as an amplitude corresponding to an extremum value of the plurality of determined values of the ion-fragmentation metric.

14. A method as recited in claim 13, wherein the value of the ion fragmentation metric at each applied RF voltage amplitude is determined as the total peak area, $A_{intact}$, of mass spectral peaks that are attributable to non-fragmented ions of the one or more introduced standard peptide, polypeptide or protein compounds that are detected while each respective RF voltage amplitude is applied to the ion funnel apparatus.

15. A method as recited in claim 13, wherein the value of the ion fragmentation metric at each applied RF voltage amplitude is determined as the ratio, $(A_{intact}/A_{fragments})$, where $A_{intact}$ and $A_{fragments}$ are, respectively, the total peak area of mass spectral peaks that are attributable to non-fragmented and fragmented ions of the one or more introduced standard peptide, polypeptide or protein compounds.

16. A method as recited in claim 13, wherein the one or more standard peptide, polypeptide or protein compounds include either the tetrapeptide Met-Arg-Phe-Ala (MRFA) or a set of HeLa digest peptides.

17. A mass spectrometry method comprising:

generating ions from a sample using an ion source;

transporting the ions through an ion transport apparatus that comprises an ion funnel portion and that has an inlet end that receives the ions from ion source and an outlet end;

transporting ions that exit from the outlet end of the ion transport apparatus to a mass spectrometer component apparatus through an exit ion lens, wherein a selected DC electrical potential difference is applied between the apparatus outlet end and the exit ion lens; and mass analyzing or otherwise manipulating the ions using the mass spectrometer component apparatus.

18. A mass spectrometry method as recited in claim 17 wherein the selecting of the selected DC electrical potential comprises selecting an algebraic sign of the DC electrical potential difference.

19. A mass spectrometry method as recited in claim 17, wherein the selecting of the selected DC electrical potential comprises selecting a magnitude of the DC electrical potential difference based on a prior calibration of a level of fragmentation of ions generated from the sample as a function of one or more of the group consisting of: DC potential applied to the apparatus outlet end and DC potential applied to the exit ion lens.

20. A method of reducing fragmentation of ions generated from a sample during transport of the ions through an ion transport apparatus that comprises an ion funnel portion, comprising:

applying a selected DC potential difference between an outlet end of the ion transport apparatus and an exit ion lens that is disposed adjacent to the outlet end, wherein a sign of the selected DC potential difference is chosen so as to accelerate the ions from the outlet end of the ion transport apparatus towards and through the exit ion lens.

21. A method of detaching adduct moieties from ions generated from a sample during transport of the ions through an ion transport apparatus that comprises an ion funnel portion, comprising:

applying a selected DC potential difference between an outlet end of the ion transport apparatus and an exit ion lens that is disposed adjacent to the outlet end, wherein a sign of the selected DC potential difference is chosen so as to retard movement of the ions from the outlet end of the ion transport apparatus towards the exit ion lens.

22. A method of generating fragment ions by in-source collision-induced dissociation of precursor ions generated from a sample during transport of the ions through an ion transport apparatus that comprises an ion funnel portion, comprising:

applying a selected DC potential difference between an outlet end of the ion transport apparatus and an exit ion lens that is disposed adjacent to the outlet end, wherein a sign of the selected DC potential difference is chosen so as to accelerate the ions from the outlet end of the ion transport apparatus towards and through the exit ion lens and a magnitude of the selected DC potential is chosen so as to cause collision-induced fragmentation of the precursor ions.

* * * * *